United States Patent [19]

Michelson

[11] 4,142,573

[45] Mar. 6, 1979

[54] ROTARY TYPE CORE MAKING MACHINE

[75] Inventor: Anatol Michelson, Columbus, Ohio

[73] Assignee: Ashland Oil, Inc., Ashland, Ky.

[21] Appl. No.: 870,942

[22] Filed: Jan. 20, 1978

Related U.S. Application Data

[62] Division of Ser. No. 784,939, Apr. 5, 1977, Pat. No. 4,083,396.

[51] Int. Cl.[2] ..... B22C 11/04; B22C 15/00

[52] U.S. Cl. ..... 164/169; 164/412

[58] Field of Search ..... 164/159, 169, 180, 181, 164/182, 186, 213, 227, 228, 322–331, 165, 166, 412; 214/16.1 A

[56] References Cited

U.S. PATENT DOCUMENTS

| | | | |
|---|---|---|---|
| 3,397,737 | 8/1968 | Tuttle | 164/327 |
| 3,508,598 | 4/1970 | York | 164/166 |
| 3,618,657 | 11/1971 | DeBie | 164/326 |
| 3,915,319 | 10/1975 | Fairburn | 214/16.1 A |

OTHER PUBLICATIONS

"The German Printed Publication" No. 2413268, 6/75.

*Primary Examiner*—Richard B. Lazarus
*Assistant Examiner*—K. Y. Lin
*Attorney, Agent, or Firm*—Van D. Harrison, Jr.

[57] ABSTRACT

Disclosed is a rotary-type continuous motion core making machine capable of carrying a number of core mold boxes, each supported on a carrier adapted to move up and down, a sand distributing system adapted to inject a foundry sand mix into each of the core boxes, and a manifold system for distributing curing and purging gases to the core boxes. The machine is capable of completing a core/mold production cycle in a single circle of turret revolution. The vertical movement of the core box carrier, horizontal radial movement of portions of the gas manifold system, and movements of other parts of the machine are generated by the turret rotation and are controlled by a number of stationary contoured cam tracks. Disclosed also is a novel catalyst gas generating system, a core box assembly containing ejector pins in the top portion thereof, and a system for collecting and assembling components into a unified core and mold assembly.

1 Claim, 26 Drawing Figures

14
21
17
16
20
18
28
100
124
99
97
22
130
129
26
1
6
5
27
3
4
8
67
74
73
66
7
35
63
70
12
13
64
33
2
13
34
54
65
62
31
10
29
32
9

ROTARY TYPE CORE MAKING MACHINE

This is a division of application Ser. No. 784,939 filed Apr. 5, 1977 and issued as U.S. Pat. No. 4,083,396 on Apr. 11, 1978.

NATURE OF INVENTION

This invention relates to apparatus for making sand articles, particularly foundry sand cores and molds. More particularly this invention relates to apparatus for making foundry sand cores and/or molds by "cold box" processes wherein sand containing a hardenable binder is blown into a mold, (usually a two-part core box) and a gaseous hardening agent for the binder subsequently is forced through the core thereby forming a solid molded article.

PRIOR ART

The preparation of foundry sand molds and cores from mixtures of sand and resins which are hardened by exposure to a gaseous catalyst is now commonly known. For example, U.S. Pat. NO. 3,008,205 discloses the use of an acid gas such as chlorine or hydrogen chloride to "cure" molded shapes of sand mixed with various resins. U.S. Pat. No. 3,409,579 discloses the preparation of foundry molds and cores by passing a gaseous tertiary amine through shaped mixtures of foundry sand with organic solvent solutions of phenolic resins and polyisocyanates.

In order to increase efficiency and economy in making foundry cores, it has been proposed to reduce the core making operation to a series of routine steps performed by a turntable which rotates each of a number of core boxes through a sequence of successive stations. One step in the core making operation is performed at each station. U.S. Pat. No. 3,059,294 discloses such a system. Core making machines of this type, however, are limited to stop-and-go operations. The machine can move no more rapidly through each station than the time required by the slowest operation. Appreciable accumulations of time are consumed for turntable indexing during which no core making work is performed. Another disadvantage of existing core-making machines is that they are only partially automatic. The machine component, operating at each station, requires its own drive since operating stops are performed only during the dwell period.

OBJECTS OF THE INVENTION

One object of this invention is to provide a machine for making foundry sand cores at a high productivity rate. Another object of this invention is to provide an apparatus for making foundry sand cores at a low cost per unit. Still another object of this invention is to make available a core making machine having sufficient versatility to produced simultaneously both cores and molds, each optionally of different sizes and shapes.

Other objects and advantages of the invention will become apparent from the following description.

SUMMARY OF THE INVENTION

The apparatus of this invention has as a basic element, a two-tiered or two-level turret. Vertical walls divide the lower tier into equally spaced bays. In each bay there is mounted on the lower tier a carrier table which supports the lower half (the drag) of the core box. The carrier table can be moved up and down within the lower tier as the turret revolves. On the upper tier of the turret are mounted a corresponding number of horizontally retractable carriages adapted to receive and support in a suspended fashion corresponding upper halves of core boxes (copes) and further adapted to receive and disperse gas through the core box halves.

Sand-filling means, including one blowhead for each core box, are supported above and adapted to be connected to and disconnected from corresponding core box halves. A gas manifold system is connected to the blowheads and retractable carriages distribute curing gas and air. An adjunct to the gas manifold system is a rotary valve which controls the flow of gas through the manifold system. Vertical movement of the carrier tables within the lower tier as well as the movement of other parts of the machine are controlled by cam tracks of specific profile mounted within the machine. Auxiliary equipment transfers cores and molds from the apparatus to a conveyor system for assembly and use.

In another aspect, this invention comprises a two-part core box having cam operated ejector pins incorporated therein. In still another aspect this invention comprises a catalyst gas metering system controlled and regulated by the rotation of the two-level turret.

DESCRIPTION OF INVENTION

The preferred embodiment of the apparatus of this invention is depicted in the accompanying drawings. Before, however, describing the apparatus of this invention, it should be noted that the term "sand mix" used herein denotes any type of foundry aggregate mixed with a gas-curable binder component used to manufacture foundry cores and molds such as the benzylic ether-polyisocyanate resin described in U.S. Pat. No. 3,409,579 cured with a tertiary amine or the aluminum phosphate composition described in British Pat. No. 812,352 cured with ammonia gas.

To facilitate the description of the machine of this invention, its major components are described individually. The description is then amplified by an over-all explanation of the machine. Finally, there are disclosed additional components which are not essential to the basic machine but which facilitate its use.

TURNTABLE AND DRIVE UNIT

Figure 1:
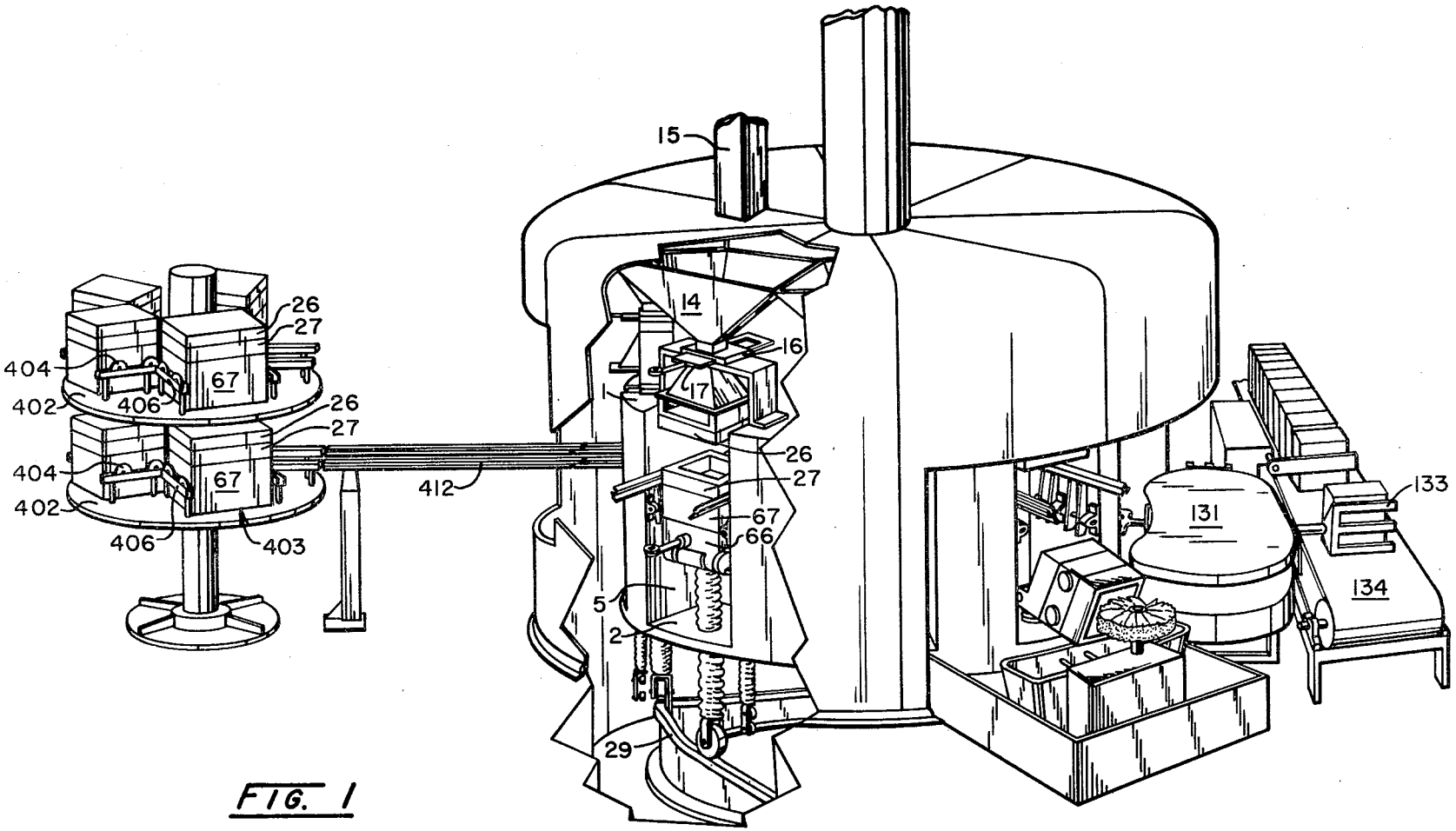
FIG. 1 is an overall perspective view of the core making machine and auxiliary components constructed in accordance with the present invention, certain parts being shown as broken away and in secion for clarity in the drawing.
Figure 4:
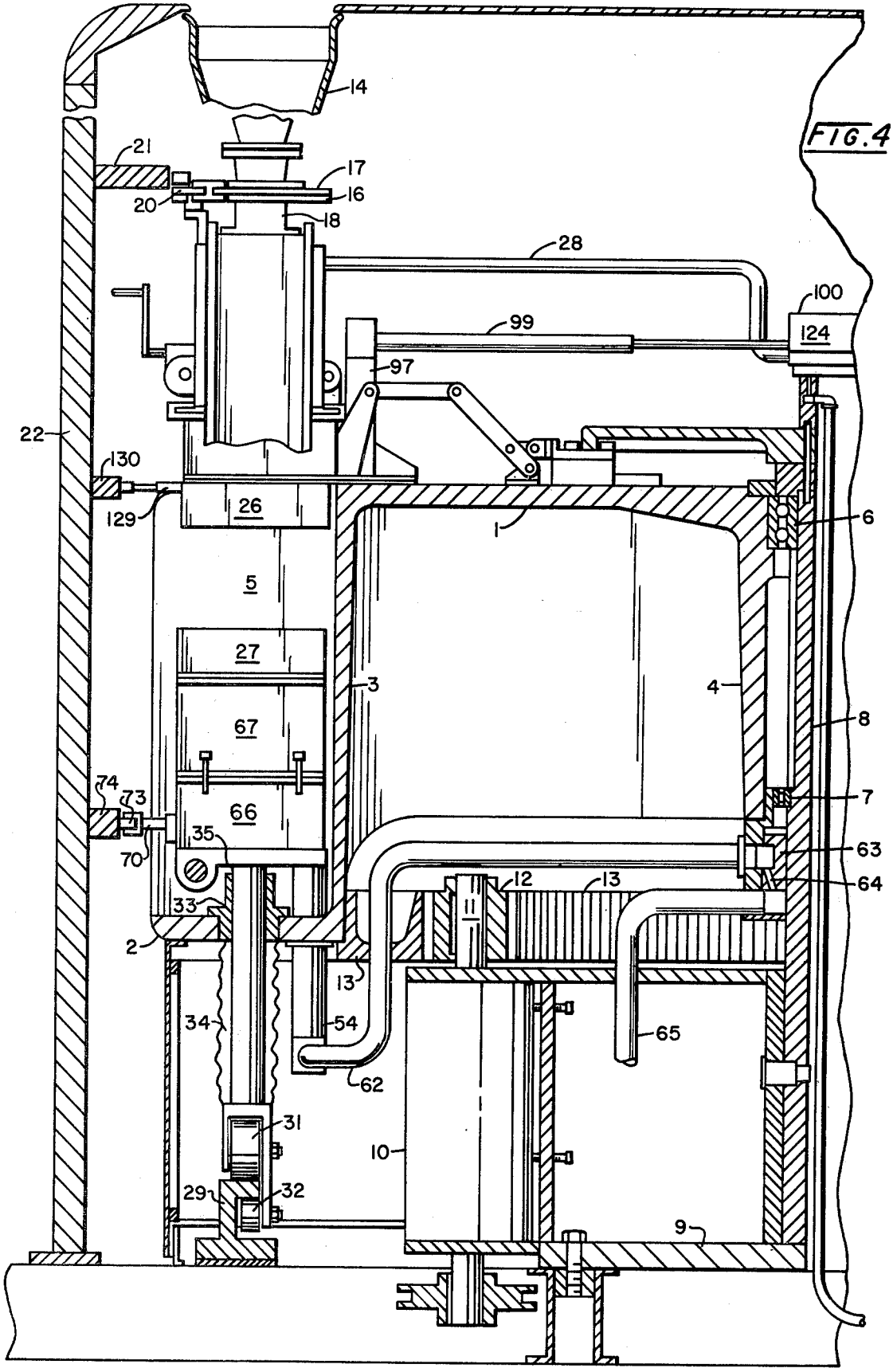
FIG. 4 is a fragmentary left side elevational view taken along line 4—4 of FIG. 2.

The basic element of this machine, the two-tiered turntable or turret, is most clearly shown in FIGS. 1 and 4. The turntable is made up of two concentric circular tiers 1 and 2 connected by vertical cylindrical walls 3 and inner support sleeve 4. Top tier 1 extends radially to approximately the same radius as lower tier 2 but contains cut-out sections to accommodate the individual core boxes and support tables. In addition, vertical walls 5 extend from the lower tier 2 to corresponding edges of the cut-out radius of the upper tier 1, defining bays. Center bearing assemblies 6 and 7 support cylinder section 4 so that it is free to rotate around vertical support post 8 rigidly mounted on base plate 9. Motor 10 mounted on the base of the machine engages the inner periphery of tier 2 by means of drive shaft 11 and gear assemblies 12 and 13. Gear wheel 13 is rigidly attached to cylindrical wall 3. This portion of the machine thus is assembled so that the turntable components 1, 2 and 3 are free to rotate about fixed support post 8 through the action of drive motor 10. It will be understood that in FIG. 4, only the left half of a cross sectional view is shown and that the right half would essentially be a reverse image.

SAND SOURCE, HOPPER AND ENCLOSURE

Referring now to FIGS. 1, 2, 3, 4 and 6, reference numerals 14 denote a series of sand hoppers arranged touching each other in a full circle around the upper part of the machine. The source of foundry sand is designated at 15. The level of sand in the hoppers 14 is controlled by means already well known. Each hopper tapers inwardly and down to gate valve 16 which by means of slidable gate 17 obstructs or clears the passageway 18 leading to blowhead 19. The opening and closing of gate 17 is controlled by cam rod and wheel assembly 20, one end of the rod being attached to the edge of gate 17. The other end of the rod 20 engages and rides along double-rail cam track 21. Each rail of cam track 21 is supported by and extends inwardly from structural beams 22. The distance cam track 21 extends horizontally in from 22 determines the opening and closing of gate 17 with reference to opening 18.

In a varient of this arrangement, the passageway 18 can be opened and closed by a pneumatically or electrically operated gate valve synchronized with other functions of the machine.

Figure 6:
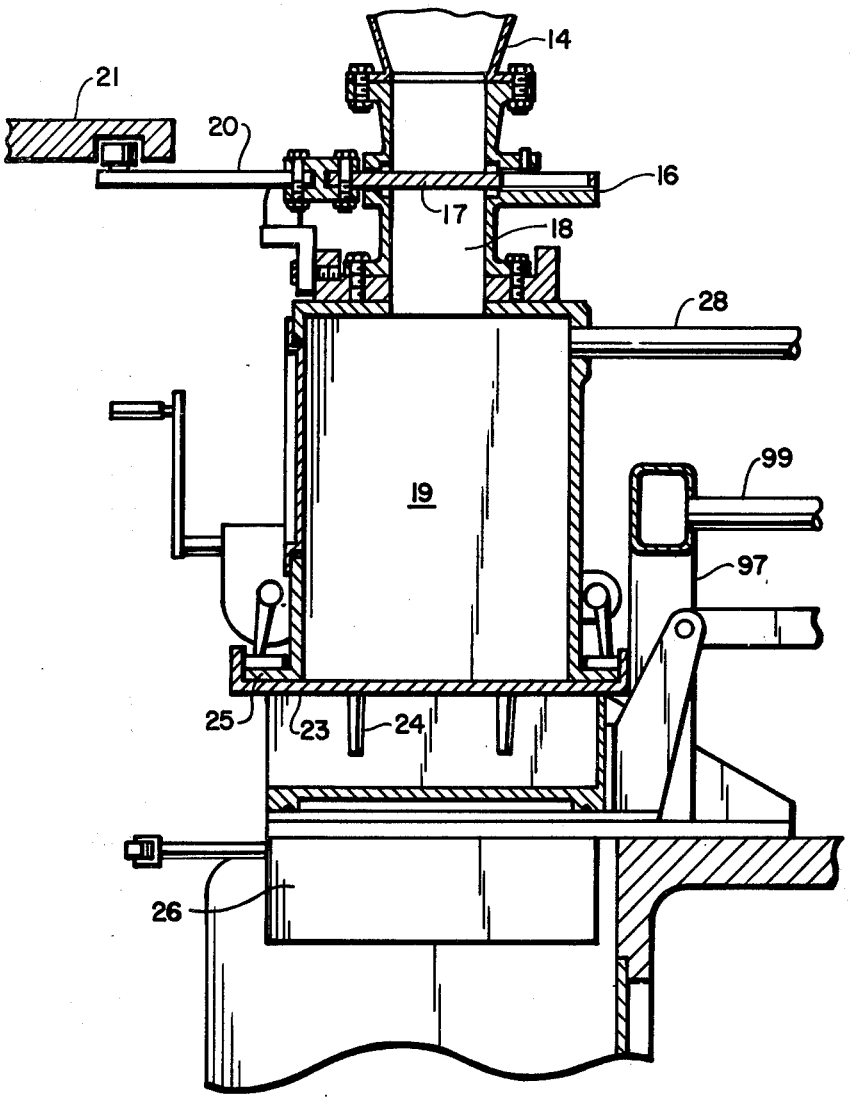
FIG. 6 is a partial side elevational view taken along line 6—6 in FIG. 5.

Blowhead plate 23 with nozzles 24 is rigidly attached to the bottom of blowhead 19 at flange 25 by any means desired. FIG. 6 depicts generally a shaft and gear mechanism with locking dogs. It is to be understood that other means of attaching plate 23, however, can be used as bolts, clamps and the like. The nozzles 24 correspond to the configuration of the top half (the cope) 26 of two-part core box 26 and 27. Conduit 28 rigidly attached to blowhead 19 admits air to the blowhead on a predetermined schedule.

CORE BOX CARRIER ASSEMBLY

Figure 7:
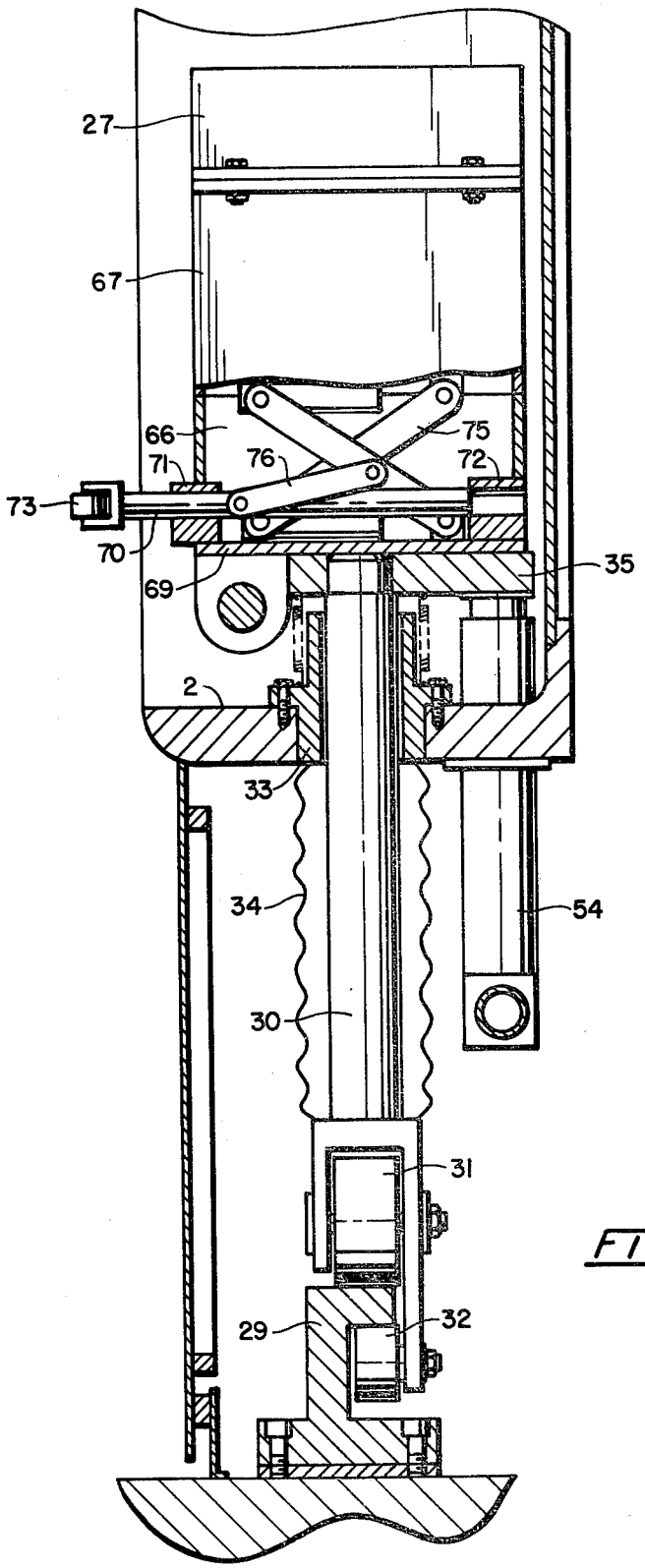
FIG. 7 is a partial side elevational view taken along line 7—7 of FIG. 5.

That portion of the machine which support the lower half 27 (the drag) of the two-part core box assembly and which raises and lowers the lower half of each core box in a predetermined sequence is shown primarily in FIG. 7 and more generally in FIGS. 1, 3, 4, 5, 8, 9 and 17.

Referring to FIG. 7 primarily, reference numeral 29 denotes a circular can track having a constant horizontal radius with reference to the axis of support post 8 but having a varied vertical height in cross section. Cam rod 30 has attached rollers, 31 and 32, which engagek cam track 29. Rod 30 extends up through shouldered bushing 33, the latter extending through lower tier section 2. Collapsible sleeves 34 and 35 protect the surface of rod 30 and are attached to rod 30 at a point near each end.

Figure 8:
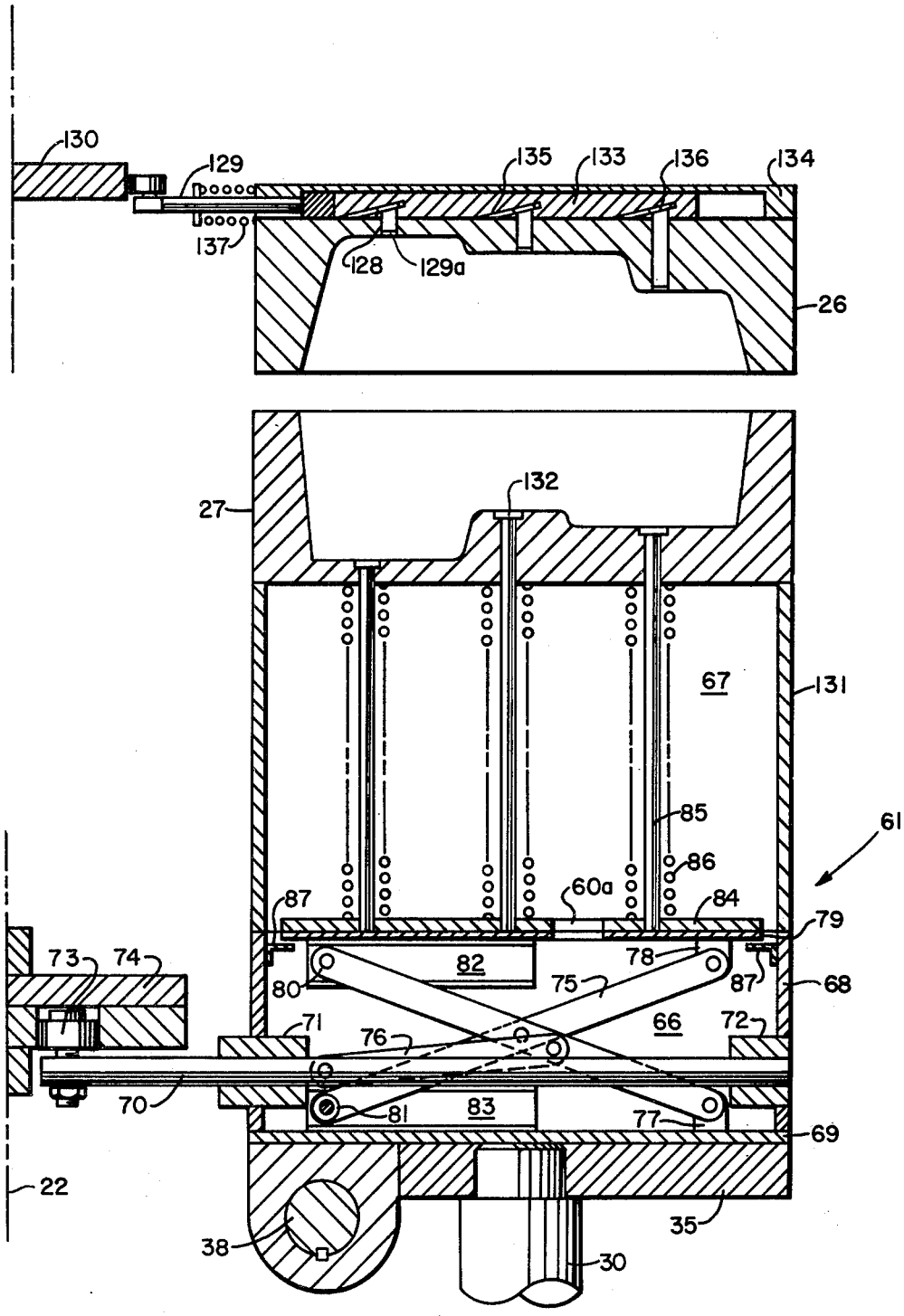
FIG. 8 is a side elevational view of the core ejector component of the machine.
Figure 9:
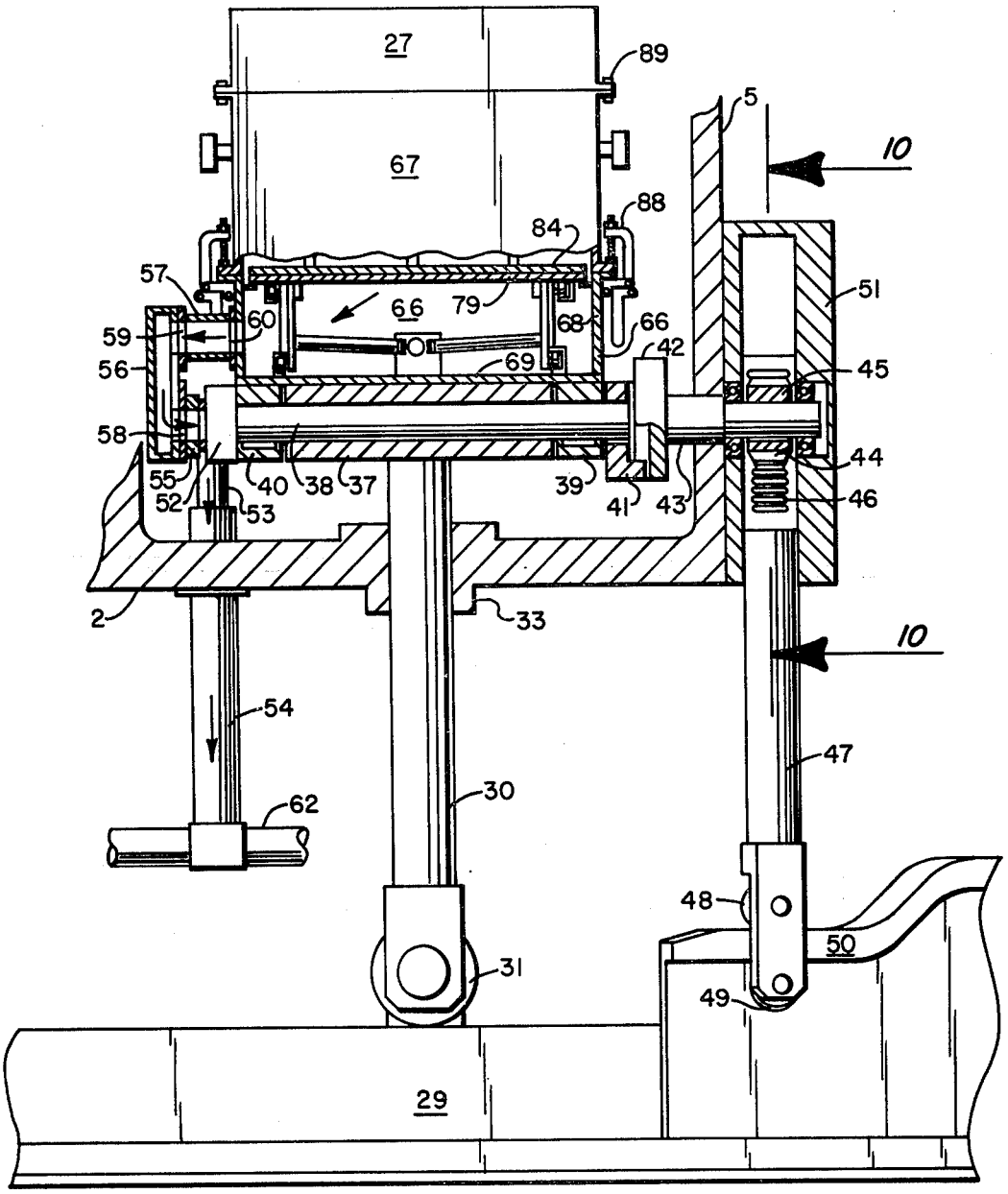
FIG. 9 is a front elevational section view of the core box assembly tilting mechanism.
Figure 10:
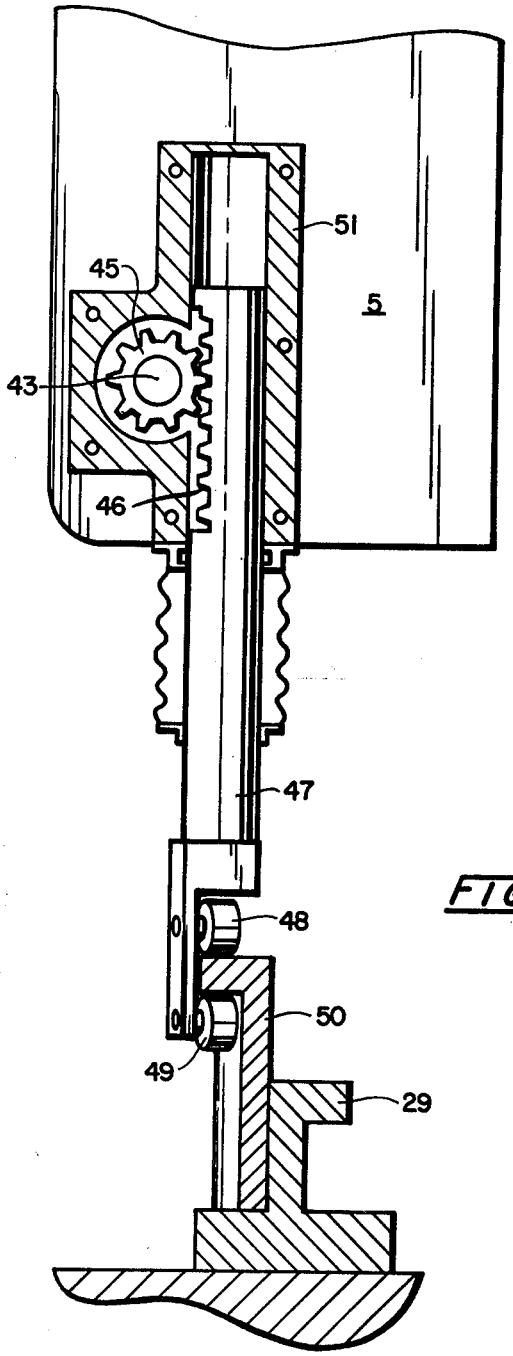
FIG. 10 is a side sectional view taken along line 10—10 of FIG. 9.
Figure 11:
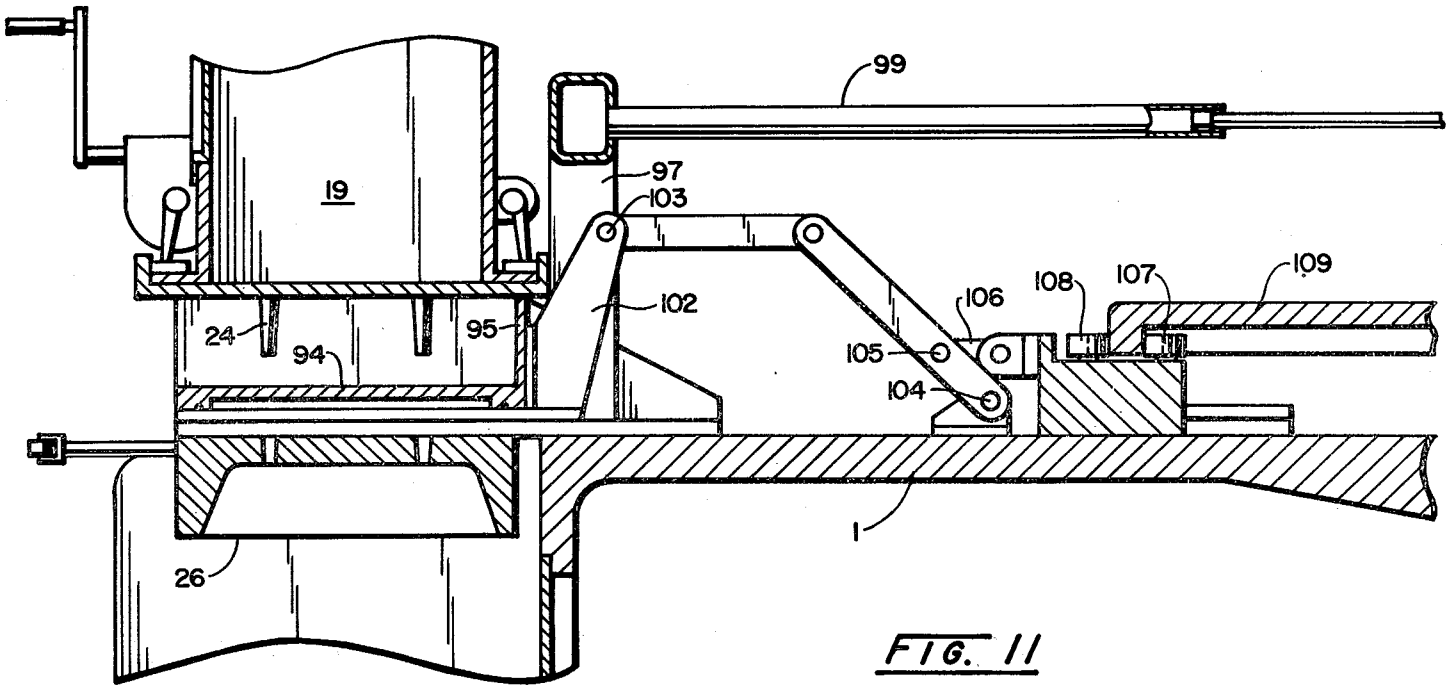
FIG. 11 is an enlarged fragmentary elevational view of a portion of FIG. 4.

FIGS. 8 and 9 shown in greater detail that portion of the mechanism which carries curing gas and purge gas from the core box assembly, ejects the cured core, and tilts outward the lower half of the core box. Cam rod 30 rides over cam track 29 and raises or lowers table 35 and the core box lower half 27. The upper end of cam rod 30 is rigidly attached to table 35. Rigidly attached to table 35 is sleeve 37, enclosing shaft 38. Shaft 38 extends through and is keyed to bearings 39 and 40 and has attached, at one end, one half of the clutch mechanism 41. Bearing sections 39 and 40 are rigidly attached to the bottom of lower section 66 and keyed to shaft 38. The other half of the clutch mechanism 42 is attached by a short shaft 43 to rack and pinion 44. The clutch mechanisms 41 and 42 are constructed so that the two halves are free to pass over each other in a vertical direction but which engage each other when rotated about the longitudinal axis of shafts 38 and 43. As best shown in FIG. 9, the rack and pinion 44 is made up of shaft 43 connected with a pinion 45. It in turn engages with the rack 46 which is an extension of cam rod 47. To avoid unnecessary complication of the drawings, indication of cam rod 47 has been omitted in FIG. 4 and FIG. 7. The lower end of cam rod 47 by means of rollers 48 and 49 rides along cam track 50 which, if desired, can be a part of cam track 29. Housing 51 attached to wall 5 supports and positions shaft 43 and rod 47. It will be readily apparent that if rod 47 in riding over cam track 50 moves upwardly, shaft 43, shaft 38 and bearing sleeves 39 and 40 keyed to shaft 38 will rotate, forcing lower section 66 to be tilted outwardly.

Cam track 50 is used for only a small portion of a cycle during the time when it is necessary that the lower half of the core box be titled outwardly. Cam track 50 thus may extend only part way around the circumference of the machine. Cam track 50 serves to control the movement of rod 47 and pushes rod 47 up when the outward tilting of lower section 66 is desired during a cycle, or down when table 35 is to be returned to its original position.

Located at the other end of shaft 38 is a series of interconnecting gas-tight chambers. Chamber 52 is fixed in a gas-tight relationship to telescoping sleeves 53 and 54 which extend and contract vertically in accordance with the height of table 35 above outer lower tier 2. Chamber 52 is connected by means of gas-tight rotary seal 55 to chamber 56 which in turn is connected in gas-tight relationship with rotary seal 57. Chambers 52 and 56 are open at ports 58, 59 and 60 so that gas can flow freely from gas collection chamber 61 as shown by the arrows in FIG. 9. This portion of the apparatus thus functions so that gas collection chamber 61 can be rotated about the axis of shaft 38 when rod 47 moves vertically. At the same time, the gas-tight chambers 52 and 56 are free to adjust to the rotation of chamber 61. As shown in FIG. 9, telescoping sleeve 54 connects with conduit 62 which by means of rotary gas valve 63 is vented through port 64 to an exhaust gas conduit 65. Rotary gas valve 63 is designed so that it is free to rotate about support post 8 while free to receive waste gases through conduit 62 from each bay.

CORE BOX ELEVATING MECHANISM

FIGS. 7, 8 and 9 shown in detail the construction of gas collection chamber 61. Gas collection chamber 61 consists of an upper section 67 and a lower section 66. Lower section 66 is a permanent part of the machine whereas different heights of the upper section may be required depending upon the vertical dimensions of the core box it supports. Lower section 66 is defined by the enclosing walls 68 and bottom plate 69 and communicates with gas chamber 66 by port 60A. Push rod 70 extends into gas-tight bushings 71 and 72 so that rod 70 is free to reciprocate horizontally. The end of push rod 70 extending outside lower section 68 is fitted with cam wheels 73 which in turn engage cam track 74. Cam track 74 is supported by structural beam 22. Preferably cam track wheels 73 and track 74 have the configuration shown in FIG. 8 so that rod 70 can alternatively be injected or retracted into lower section 66 according to the varied cross sectional thickness of track 74. Elevating linkage 75 is connected pivotally to push rod 70 by member 76 and also to lugs 77 and 78 which are rigidly attached to floor plate 69 and to movable plate 79. The other ends of the linkage are free to slide by means of rollers 80 and 81 along the grooves defined in pieces 82 and 83 which are rigidly mounted to plate 69 and to movable plate 79. Movable plate 79 supports a second plate 84 which engages ejector pins 85 and can be changed to fit the drag sections of various configurations. Ejector pins 85 are surrounded by compressed springs 86 which bear against plate 84 and the bottom of the drag 27. It will be apparent that as push rod 70 reciprocates in lower section 66, linkage 75 will cause plates 79 and 84 to be raised or lowered, in turn, causing pins 85 to be injected into or retracted from the bottom portion (drag section) of the core box. Movable plates 79 and 84 at their lowermost position rest on shoulder 87 attached to the walls 68 of the lower section 66. The upper section and bottom section, 66 and 67, of the gas collection chamber fasten together by clamps or other means (generally shown at 88) in gas-tight arrangement. Similarly, the lower half of the core box (the drag) is attached to the top of the uppermost section by clamps or bolts shown generally at 89.

UPPER CARRIAGE SUPPORT AND GAS DISTRIBUTION CHAMBER

Figure 12:
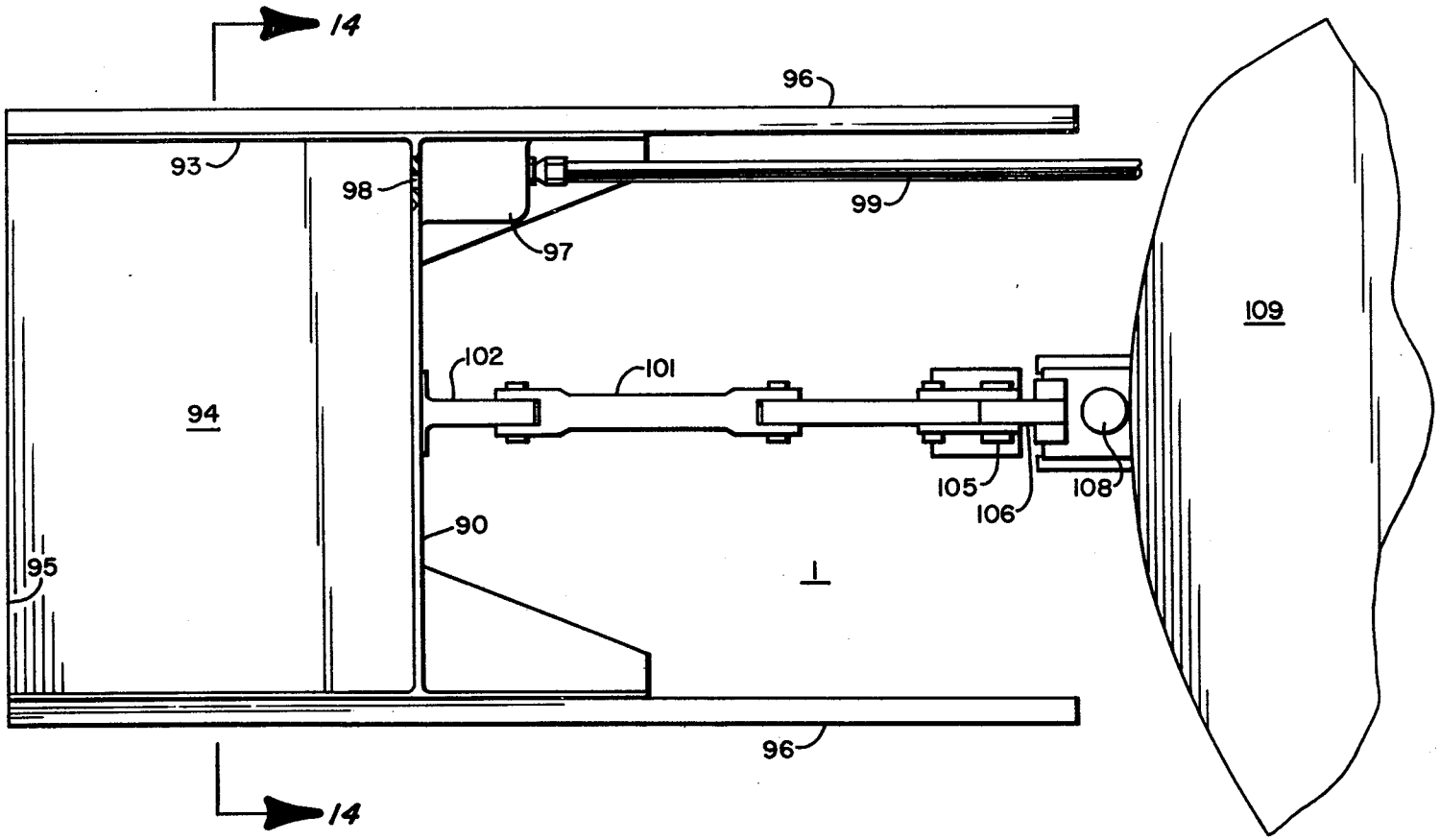
FIG. 12 is a plan view of the carriage mechanism and a portion of a horizontal cam.
Figure 13:
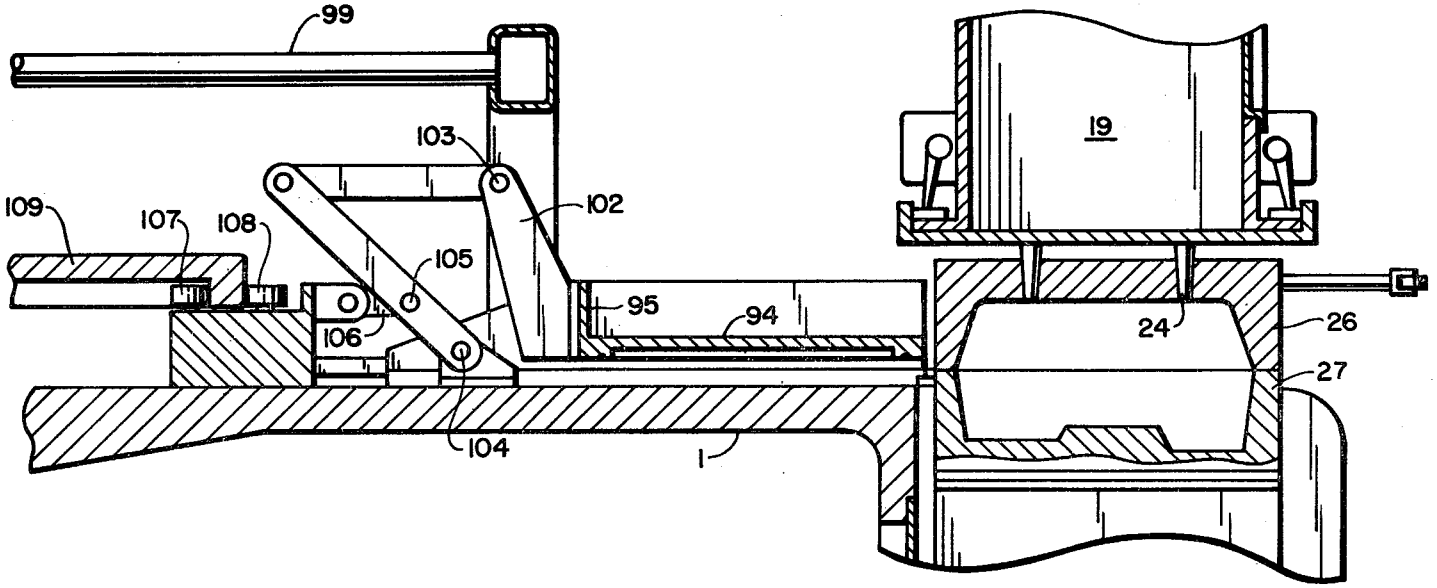
FIG. 13 is another view of the section of apparatus shown in FIG. 11 when it has been rotated approximately 60°to 90°.
Figure 14:
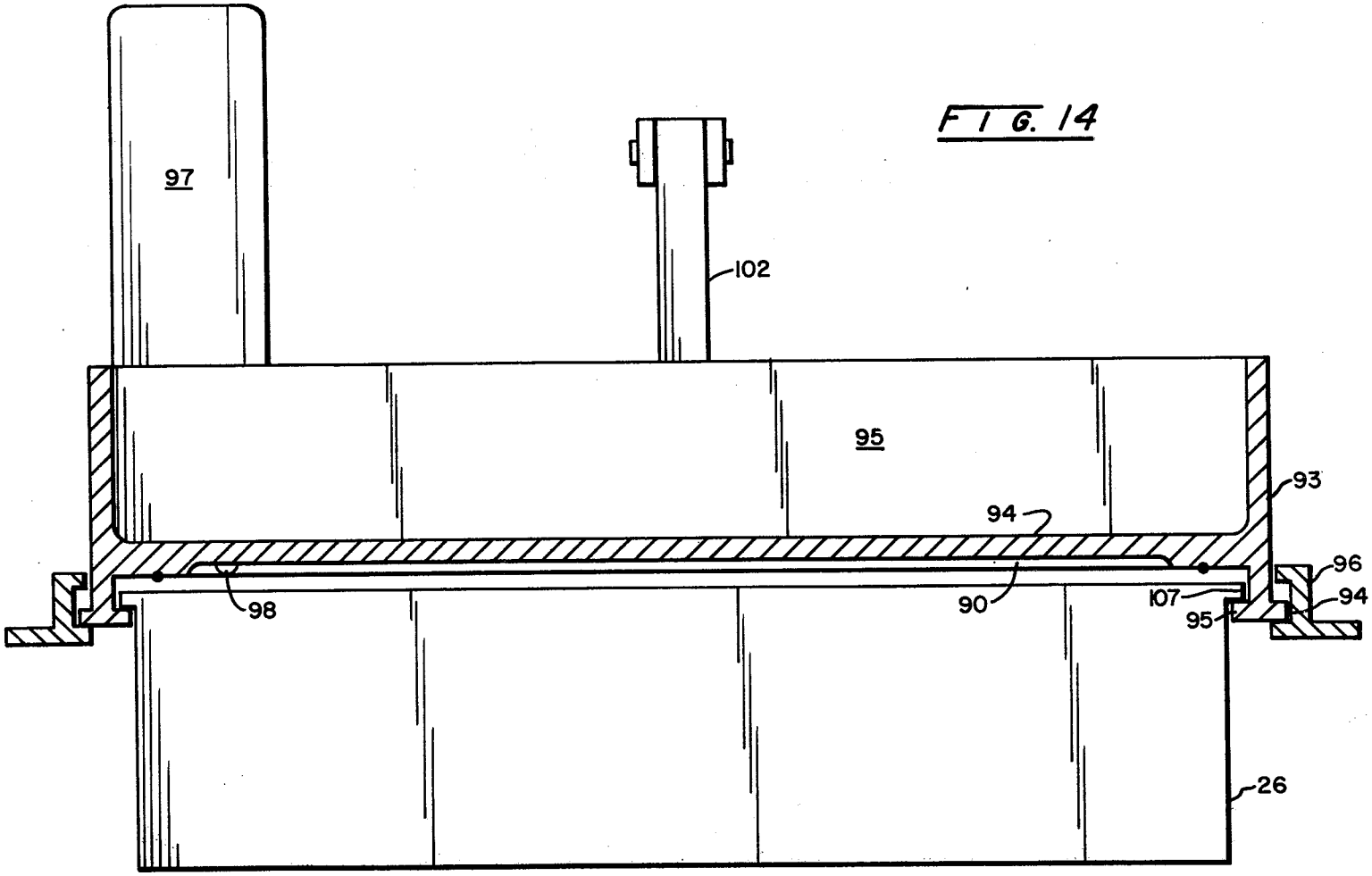
FIG. 14 is a sectional view along line 14—14 of FIG. 12.

FIGS. 4, 6, 11, 12, 13 and 14 show details of the upper carriage support. This portion of the machine supports, in part, the upper half of the core box (the cope) 26 and controls the influx of curing gas and purge air into the core box. Two parallel side walls 93, a horizontal mid section 94 and two end walls 95 define a shallow inverted gas distribution chamber 90. The side walls have along their bottom edge inward and outward, continuous projections 94 and 95 which complement grooved track section 96, rigidly attached to the top surface of upper tier 1. The gas chamber 90 is thus free to slide between the track section 96 and radially across surface 1. Gas conduit 97 connects with chamber 90 by means of port 98. Gas conduit 97 actually can be fabricated as an intergral part of the upper carriage assembly. Connected into gas conduit 97 is telescoping conduit 99 which at its other end is connected to and communicates with gas distribution valve 100. Referring now, more specifically to FIG. 12, linkage 101 pivotally connects at one end with gas chamber 90 at rigid lug 102 and is pivoted at 103, and at 104 is pivotally attached to the surface of tier 1. Linkage 101 is attached at 105 to push rod 106, the latter terminating in rollers 107 and 108. These engage cam track 109 which is stationary. As these rollers, 107 and 108, move along cam track 109 which has an irregular radial configuration, push rod 106, linkage 101 and chamber 90 will reciprocate, being guided by track sections 96. Conduit 99, in corresponding fashion, will lengthen and shorten telescopically.

ROTARY GAS VALVE ASSEMBLY

Figure 15:
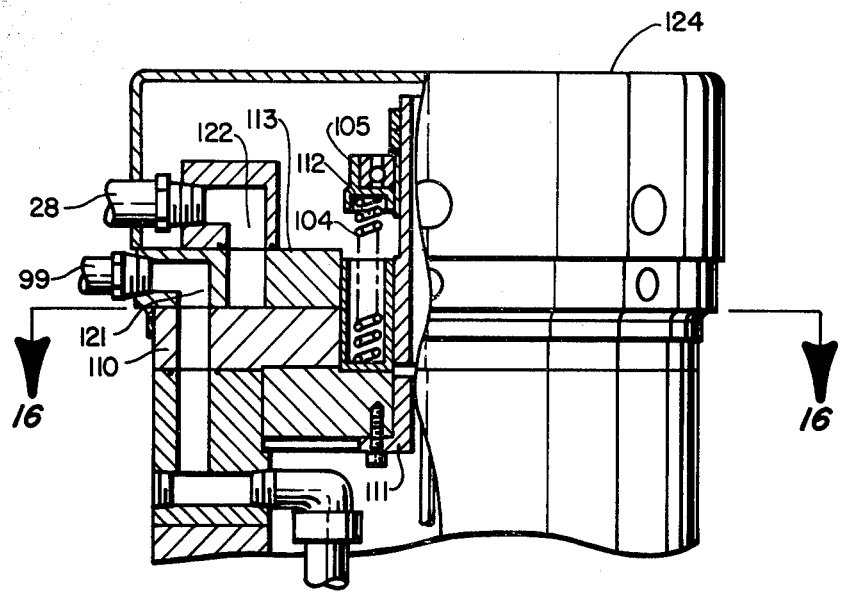
FIG. 15 is a fragmentary elevational view of the gas distribution manifold.
Figure 16:
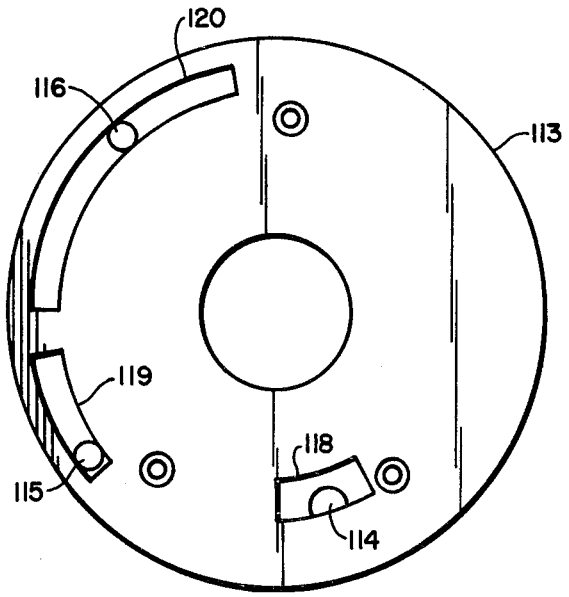
FIG. 16 is a plan view in cross section taken along the line 16—16 in FIG. 15.
Figure 17:
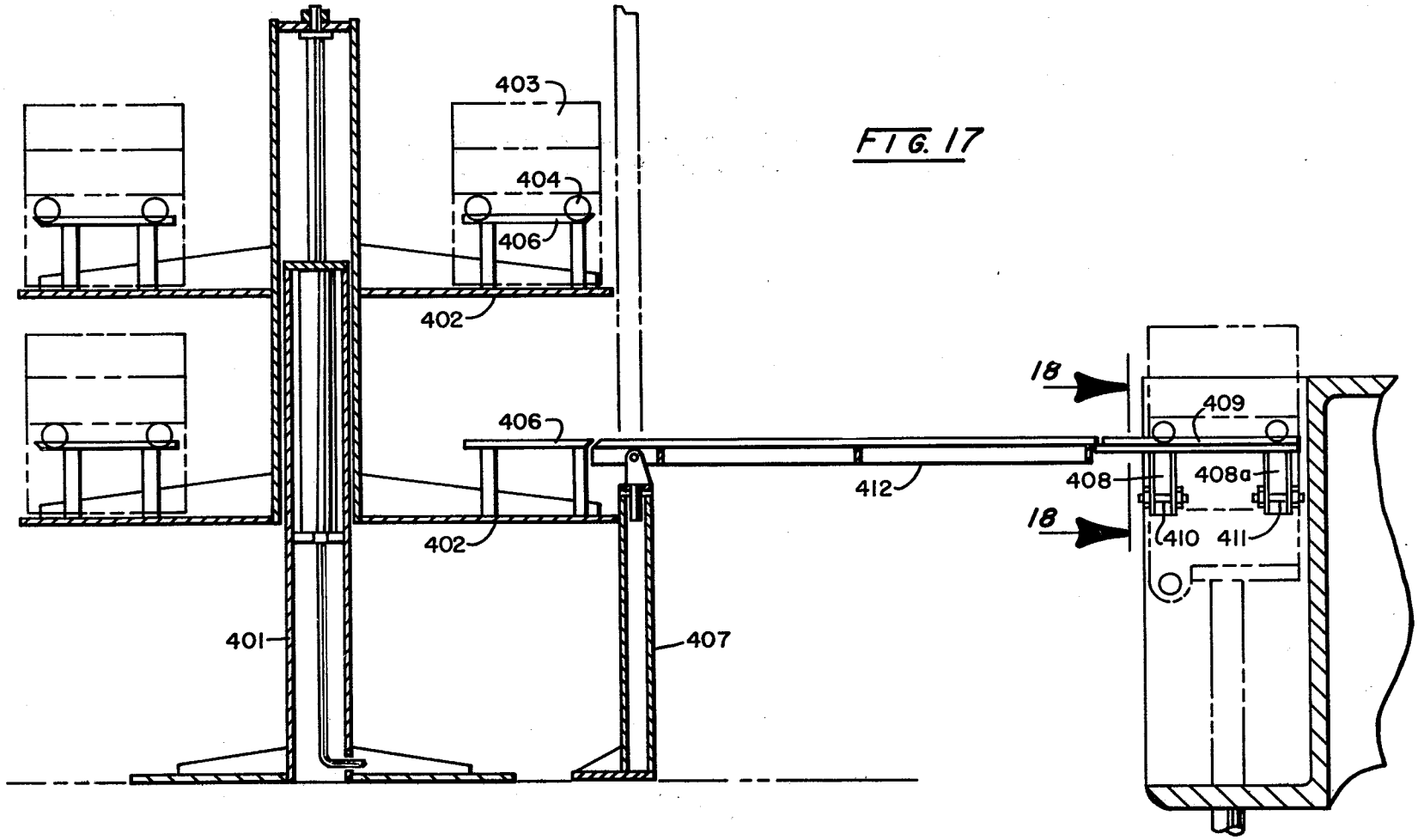
FIG. 17 is a side elevation section view of the core box assembly transfer apparatus and portion of one bay.

The gas distribution valve 100 (FIGS. 4, 15 and 16) is attached to the top of support post 8 and controls the flow of air and amine curing gases through conduits 28 and 99 to the various core boxes according to a predetermined schedule. Plate 110 is rigidly attached, by means not shown, to the top of support column 8. Plate 110 has rigidly attached to it, shaft 111 carrying a plurality of bearing and spring assemblies 112. Resting on plate 110 is rotatable plate 113. The two contacting surfaces of plates 110 and 113 are sufficiently flat that they form a gas-tight seal when pressed together. Plate 110 contains ports 114, 115 and 116. Air is supplied to ports 114 and 115. A separate conduit supplies a curing gas such an amine gas or ammonia gas to port 116. Arcuate grooves 118, 119 and 120 in the upper surface of plate 110 communicate with ports 114, 115 and 116 respectively. In rotatable plate 113, ports 121 and 122 are arrayed at equiangular spacings around plate 113 at a radial distance corresponding to the radial distance of ports 115 and 116, and grooves 119 and 120 in stationary plate 110. Conduits 99 are attached to plate 113 and and communicate with ports 121. In a similar manner, ports 122 are also formed in rotatable plate 113 so that the openings at one end are spaced equiangularly around plate 99 and at a radial distance corresponding to the radial distance of port 114 and groove 118 in stationary plate 113. Conduits 28 are also attached to plate 113 and communicate with ports 122. It will be readily apparent that if rotatable plate 113 is slowly rotated over plate 110 and air, amine gas and air are admitted to ports 114, 115 and 116, these gases will be sequentially admitted to ports 121 and 122, the duration of each gas flow being determined by the length of the corresponding arcuate grooves. The plurality of springs 104 placed in wells around the center of plate 113 are held under compression by spring-bearing assembly 105 and serve to maintain the opposing surfaces of plates 110 and 113 under sufficient compression so as to maintain a gas-tight seal. Reference numeral 124 denotes a cover for enclosing the top of the complete assembly.

OPERATION OF THE APPARATUS

Figure 19:
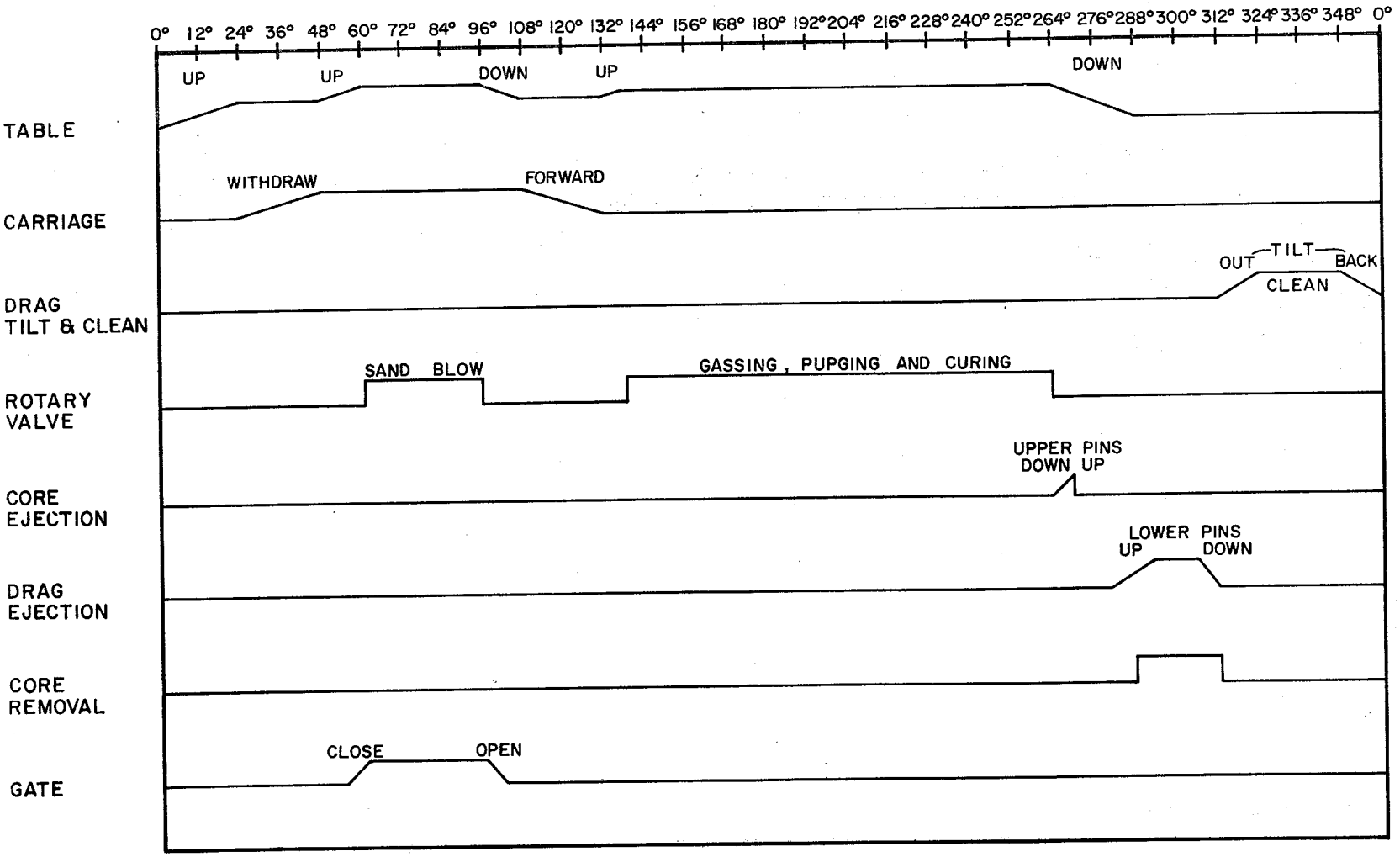
FIG. 19 is a diagram showing the cyclical functions of certain elements of the core making machine.
Figure 20A:
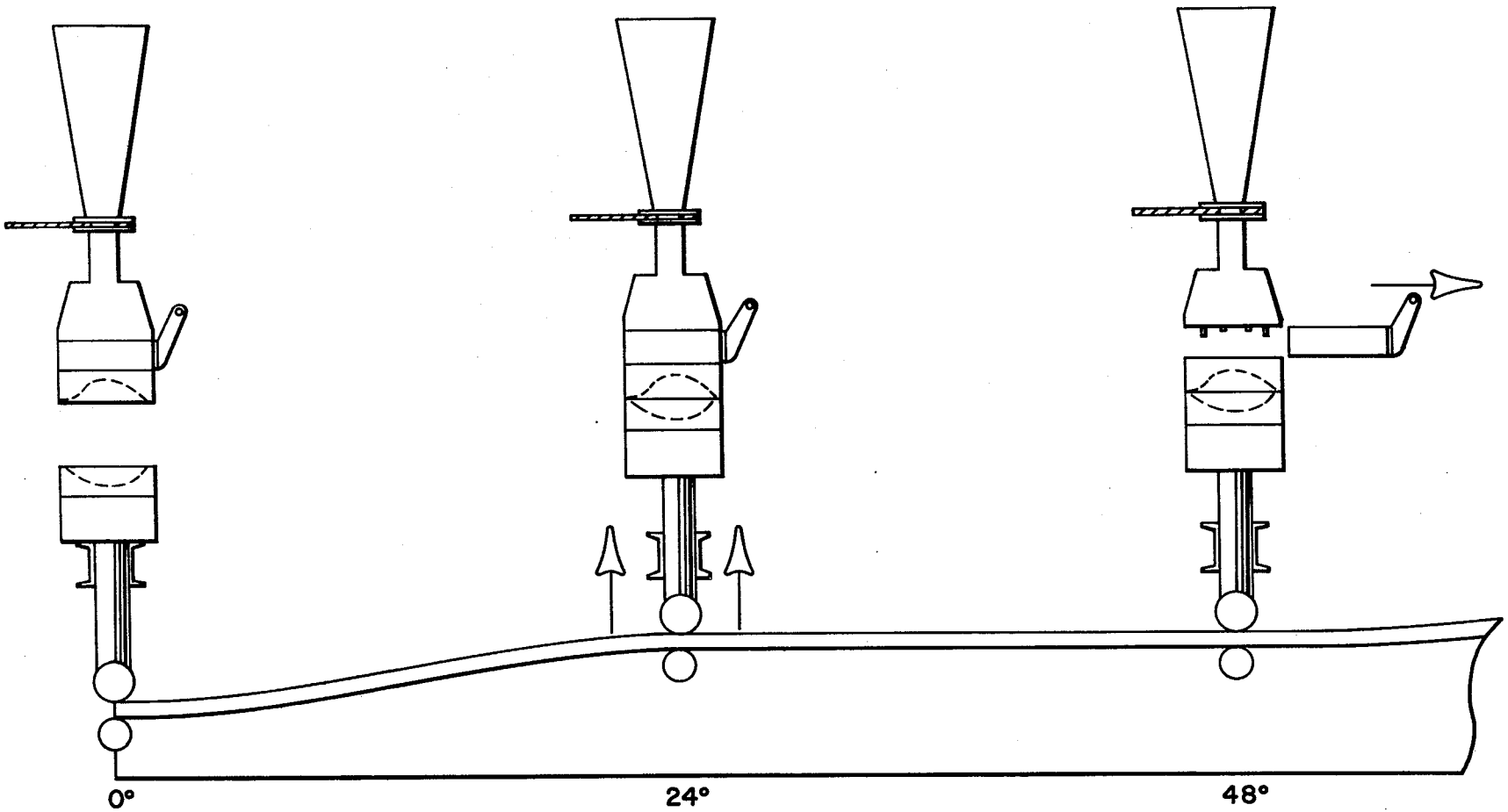
FIGS. 20A through 20E depict the position of the core box at various points in one cycle of the machine's operation.
Figure 20B:
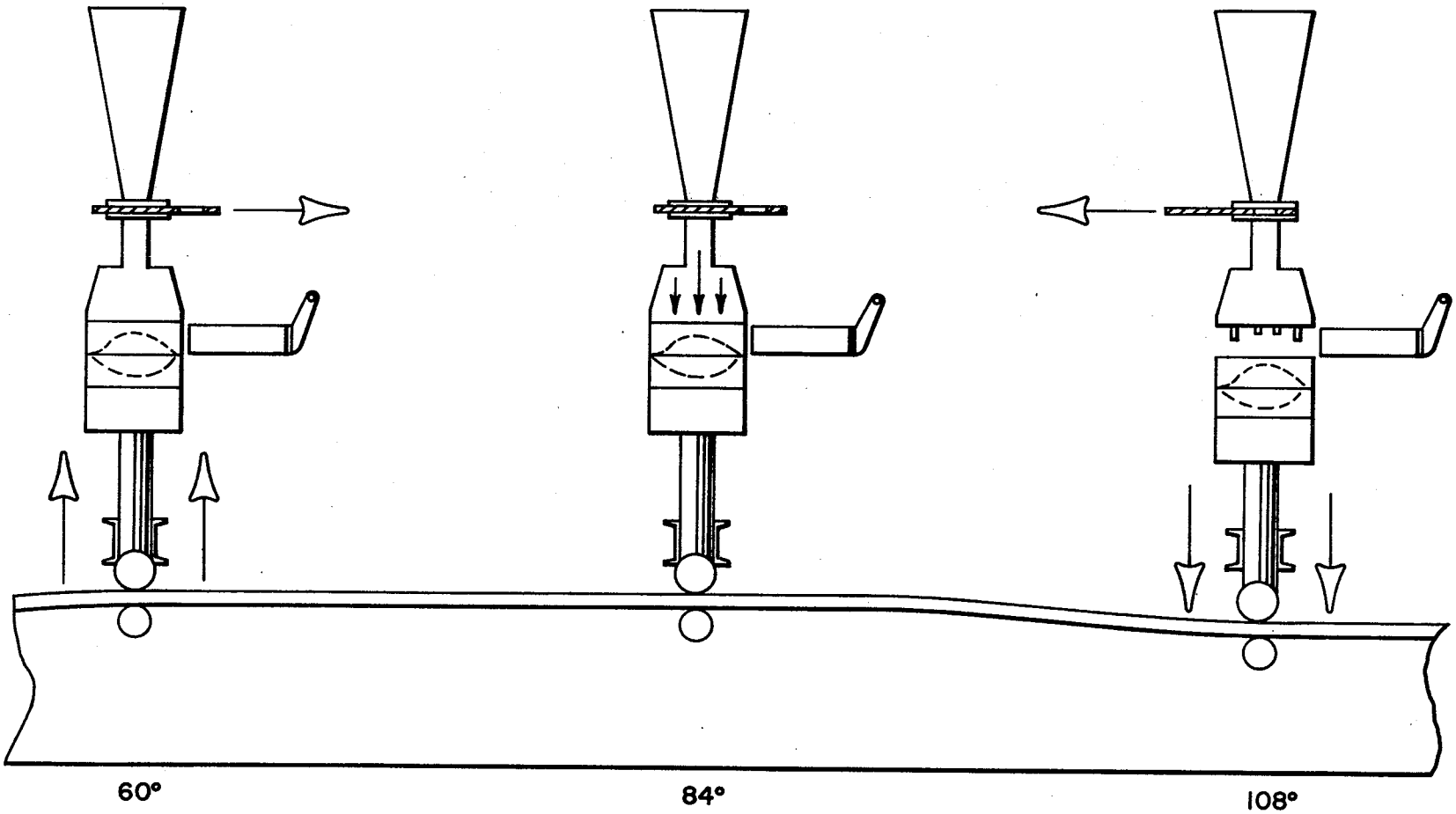
Figure 20C:
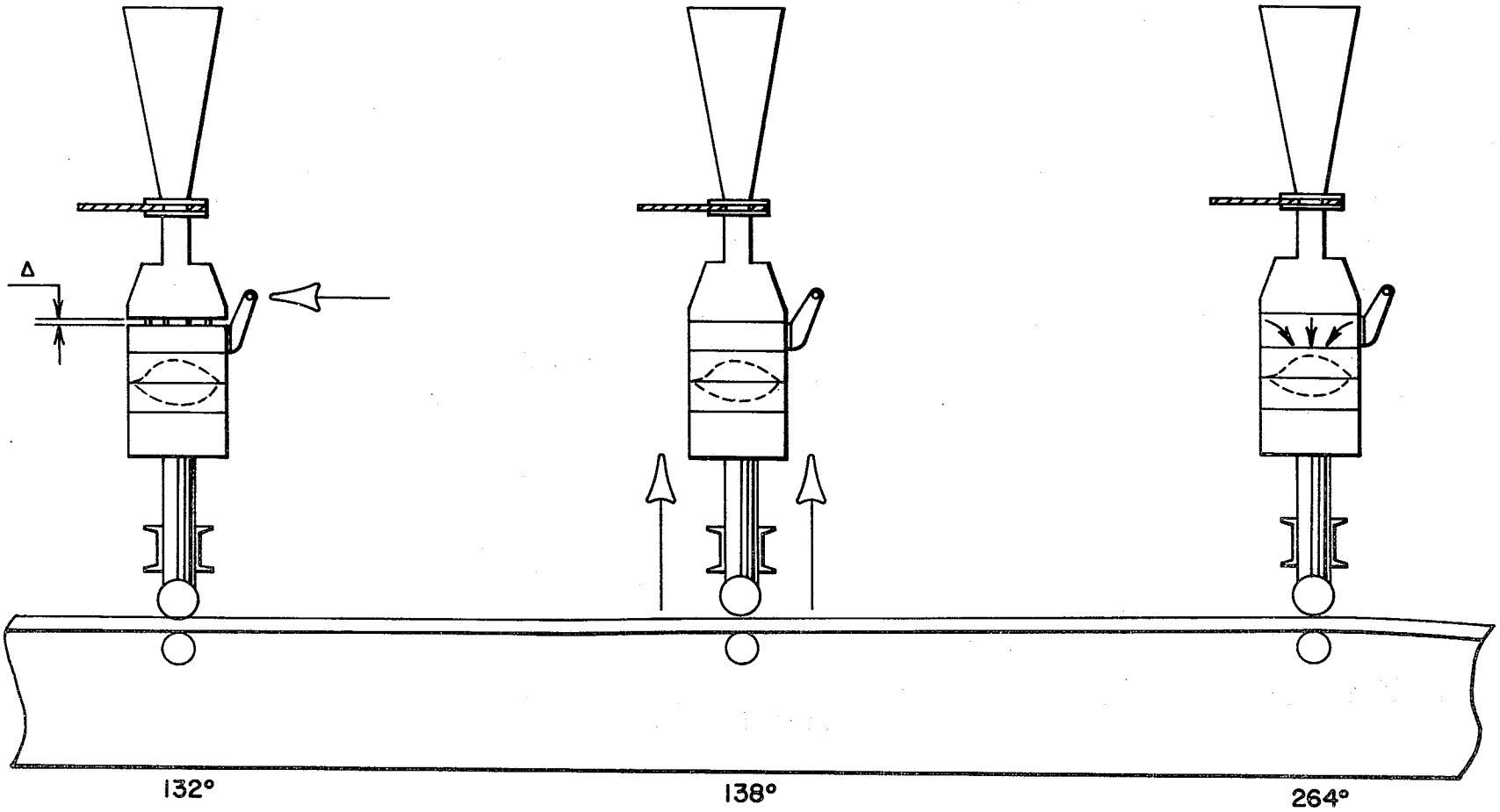
Figure 20D:
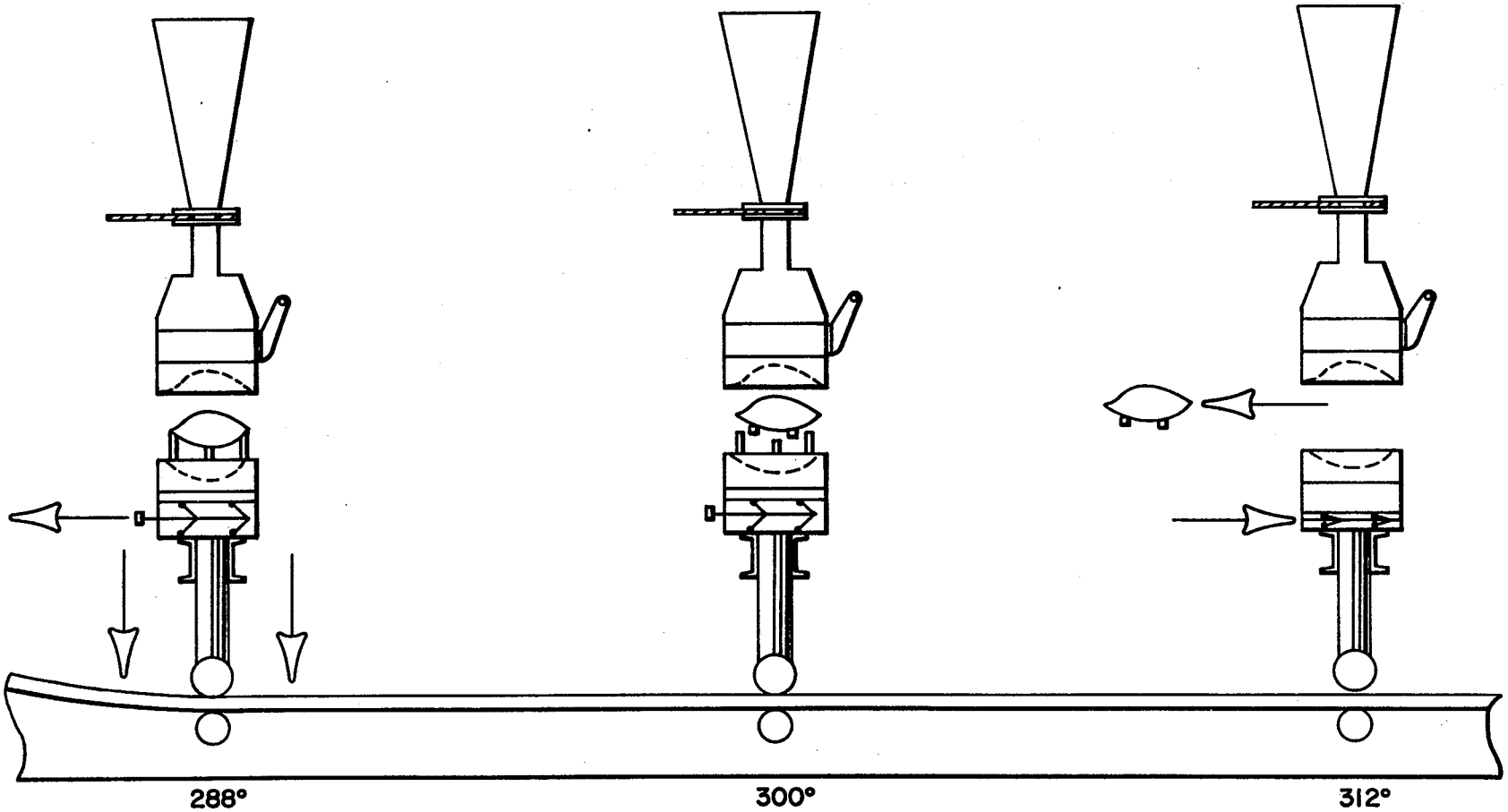
Figure 20E:
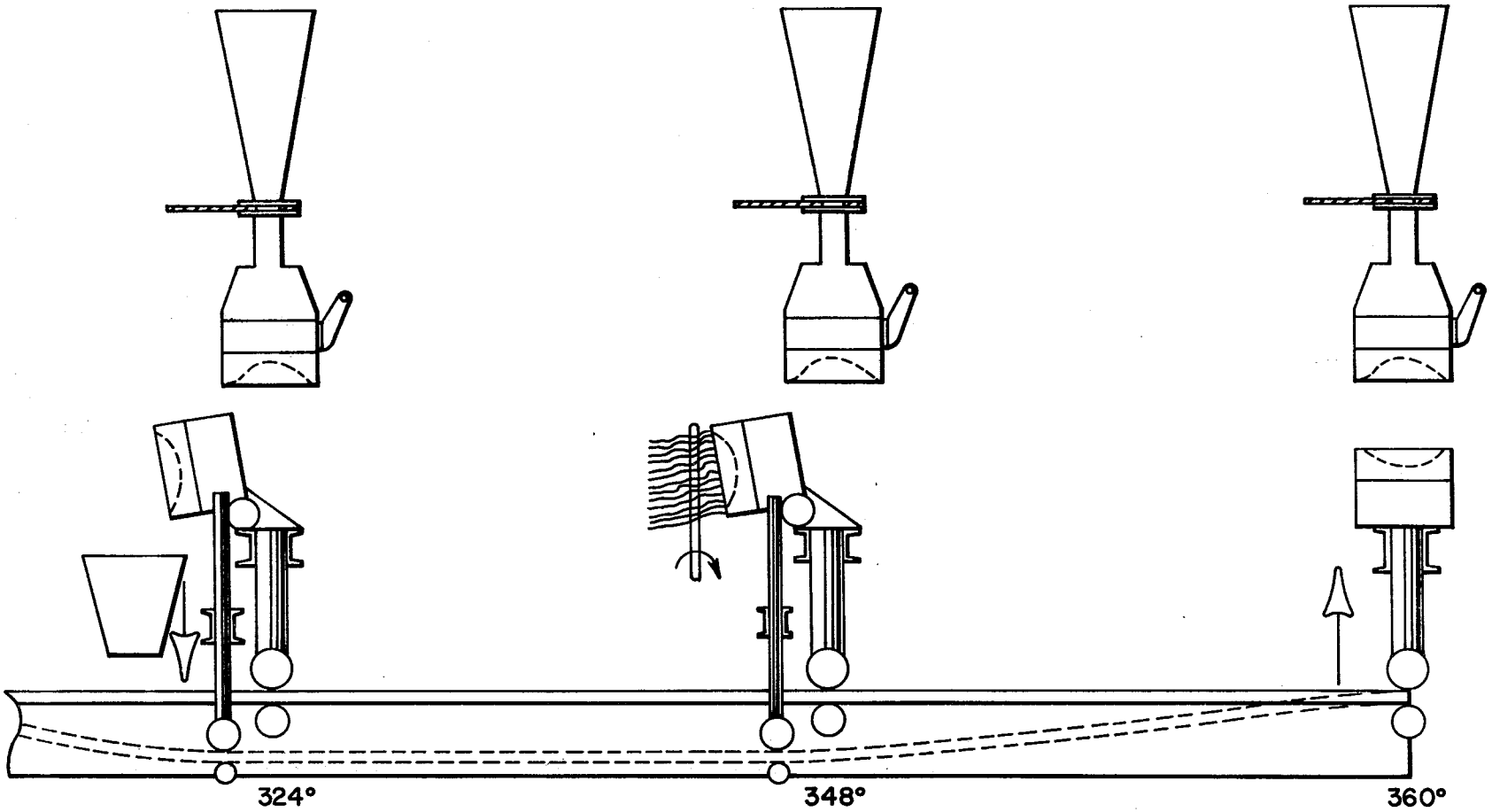

As indicated previously, the operation of the machine of this invention is cyclic, one revolution of the machine being equivalent to one cycle. One sand core is produced as each bay completes a revolution. The sequence of operation of the various components of the apparatus during one cycle is best understood by reference to FIG. 19 and to FIGS. 20A through 20E in addition to the structural figures already described. Rotation of the turntable is continuous and one function occurs during each sector of rotation specified. The cycle is assumed to begin with table 35 in its lowermost position and with the lower half, 27, of the core box cleaned. Rotation of the turntable is clockwise when the machine is viewed from above. Further, it is to be understood that the duration given below for each of the phases is only approximated and can be varied as may be desired. The time span for each phase is, of course, controlled by the speed of rotation and the length of arcuate grooves 118, 119, and 120 in plate 113.

0°–24° At this point table 35 is at its lowest point and cam track 29 is at a minimum cross sectional height. Elevating scissors linkage 75 is completely collapsed and the lower half of the core box (drag) 27 rests on upper section 67. The upper half of the core box is engaged by gas distribution chamber 90, by means of projections 95, which grasps the upper half (the cope) 26 of the core box under the shoulder sections 107. Chamber 90 is positioned at its greatest radial distance from the center of the turntable. As the turntable revolves from 0° to 24° the elevation of cam track 29 increases thereby causing rod 30 to move vertically which in turn elevates table 35 and the lower half 27 of the core box. This upward vertical movement ceases when the lower half 27 of the core box rests against the bottom of the upper half 26 of the core box (the cope).

24°–48° Gas distribution chamber 90 is now retracted onto the top of upper tier 1. Retraction occurs at this point due to the decreased radius of cam track 109 which causes linkage 101 to be pulled inward radially which in turn retracts chamber 90 inwardly.

Figure 5:
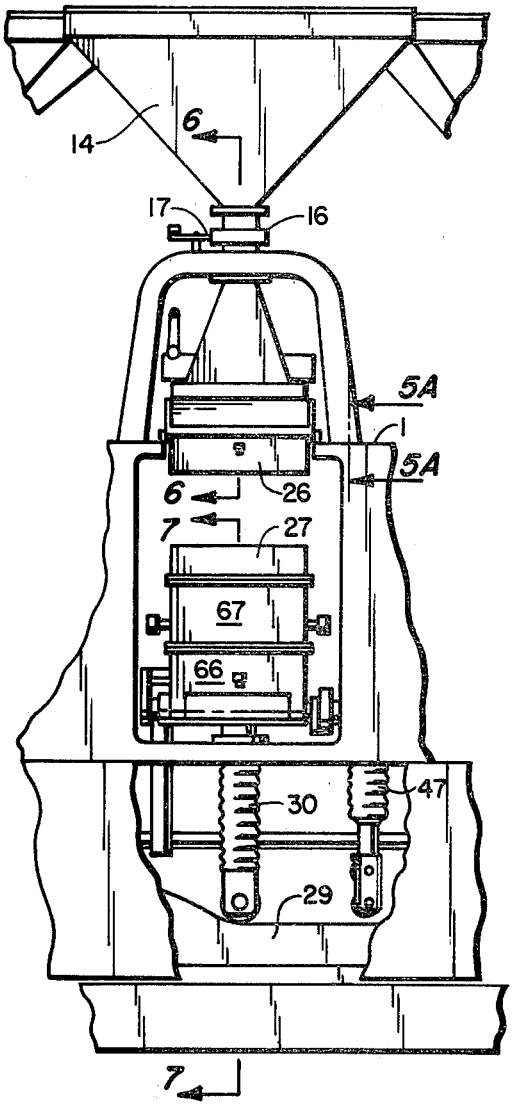
FIG. 5 is an elevational view taken along line 5—5 in FIG. 3.
Figure 5A:
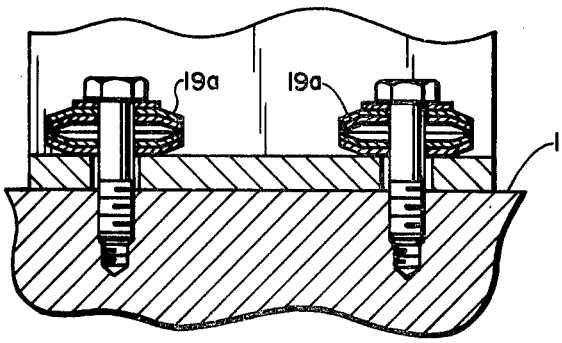
FIG. 5A is a sectional view taken along line 5A—5A of FIG. 5.

48°–60° With chamber 90 now out of the way, an increase in the height of cam track 29 urges core box (26 and 27) upwardly until it is pressed firmly against the bottom of blowhead 19 and compresses pre-compressed springs 19*a*, FIG. 5*a*. The force of the springs holds the core box halves together. During this same angular rotation, gate 17 in gate valve 16 between hopper 14 and blowhead 19 closes. Closing of the gate valve is accomplished by means of rod and cam wheel 20 resting against a raised section of cam track 21.

60°–96° During this phase of the rotation the foundry sand mix is blown from the blow chamber into the core box. Compressed air flows from conduit 28 into blowhead 19 and the foundry sand present is forced from the blowhead into the core box. The flow of compressed air through conduit 28 is controlled by the rotation of disk 113 over compressed air port 114 and slot 118 in stationary disk 110 in the gas distribution valve. Some air passes through vents in the core box and then into exhaust system 67, 66, 57, 59, 58, 54 and 62. Subsequently, a pressure release valve (not shown) in the top of the blowhead reduces pressure inside the core box to atmospheric pressure.

96°–108° During this phase, gate 17 in gate valve 16 is opened through the interaction of cam rod 20 and cam track 21. Table 35 moves downward a sufficient distance so that the upper half of the core box 26 can be engaged by chamber 90 in a subsequent phase. Downward movement is again controlled by cam rail 29.

108°–132° During this phase of rotation, chamber 90 moves radially outward. Simultaneously, the inside projections 95 along the bottom edge of chamber 95 engage the shouldered sides 107 of the upper half of the core box. Movement of chamber 90 is generated by the interaction of cam rail 109 (which during this phase has a maximum radius) linkage mechanisms 101, and rod 106. Chamber 95 remains in this forward, extended position until its withdrawal during phase 24°–48°.

132°–138° Table 35, gas collection chamber 61 and the core box (26 and 27) resting thereon are urged upwardly against the bottom of gas chamber 90 to assure a gas-tight seal. This movement is again generated by the thrust of cam rail 29 on rod 30.

138°–264° In this phase, gas curing and air purging of the sand core are accomplished. A curing gas, such as an amine or ammonia, is introduced into conduit 99 under sufficient pressure so that it flows through conduit 99, conduit 97, port 98, into the interior of gas chamber 90, through the upper part of core box 26, through the sand mass in the core box and out through the bottom of the lower half (drag) of the core box 27. Subsequently, air is forced through conduit 99 and through the cured sand core in the same flow path. The flow of curing gas and purging air is controlled by the rotation of plate 113 over grooves 120 and 119, and ports 116 and 115. Amine gas and air are supplied to ports 116 and 115 respectively.

264°–288° At the conclusion of the 138°–264° phase, a cured air-purged core is present in the core box. It must now be removed and the core box conditioned for a new cycle. At the beginning of this phase of the cycle, table 35, controlled by cam rail 29 and rod 30, begins to descend carrying with it the bottom half 27 of the core box and the cured core. To facilitate release of the core from the upper half 26 of the core box, pins 128 simultaneously at the beginning of this phase are urged downward by the action of rod 129 and cam track 130. Pins 128 ordinarily are retracted within the core box during most of the cycle. The design of the upper half of the core box is discussed in detail subsequently. At this point in the cycle, cam track 130 comes into use by forcing push rod 129 against pins 128. Near the end of the down stroke, the spring loaded pins 85 in the lower half are urged upward by the action of push rod 70 under the influence of cam 74. Push rod 70 as it is pulled outwardly away from member 77 forces linkage 75 to move plate 79 upward. Plate 79 in turn forces plate 84 and pins 85 up. Pins 85 acting on the cured core, raise it a short distance vertically. At the conclusion of this phase, the released core is completely free of the core box and is in a slightly elevated position on pins 75. The core is now ready to be removed from the turntable.

288°-312° During this phase the finished cores are removed from the turntable. Removal may be done manually, however, it is preferred to remove the cores by an endless belt having a multiplicity of "fingers" attached thereto which move under each core and lift it from the supporting pins. This facet of the machine is discussed subsequently. Near the end of this phase, the supporting pins 85 are retracted by the interaction of the elevating linkage 75, push rod 70 and cam track 74.

312°-324° At this point cam rail 50 and the rack and pinion mechanism shown in FIG. 9 functions to tilt the lower half of core box 27 up and out so it may be cleaned. Tilting is accomplished thus. Cam track 50, at this point in the cycle, rises vertically. Correspondingly, rod 47 is urged upward. The rack section 46 of rod 47 engages pinion gear 45 on shaft 43. Clutch member 42 is caused to rotate and in turn to engage and rotate clutch member 41, shaft 38, bearing and sleeves 39 and 40. Sleeves 39 and 40, gas collection chambers 66 and 67, and the lower half 27 of the core box, are all one integral whole and are caused to tilt outward as an integral unit. Any loose sand particles or pieces of broken core will form the drag into a waste collector.

Figure 2:
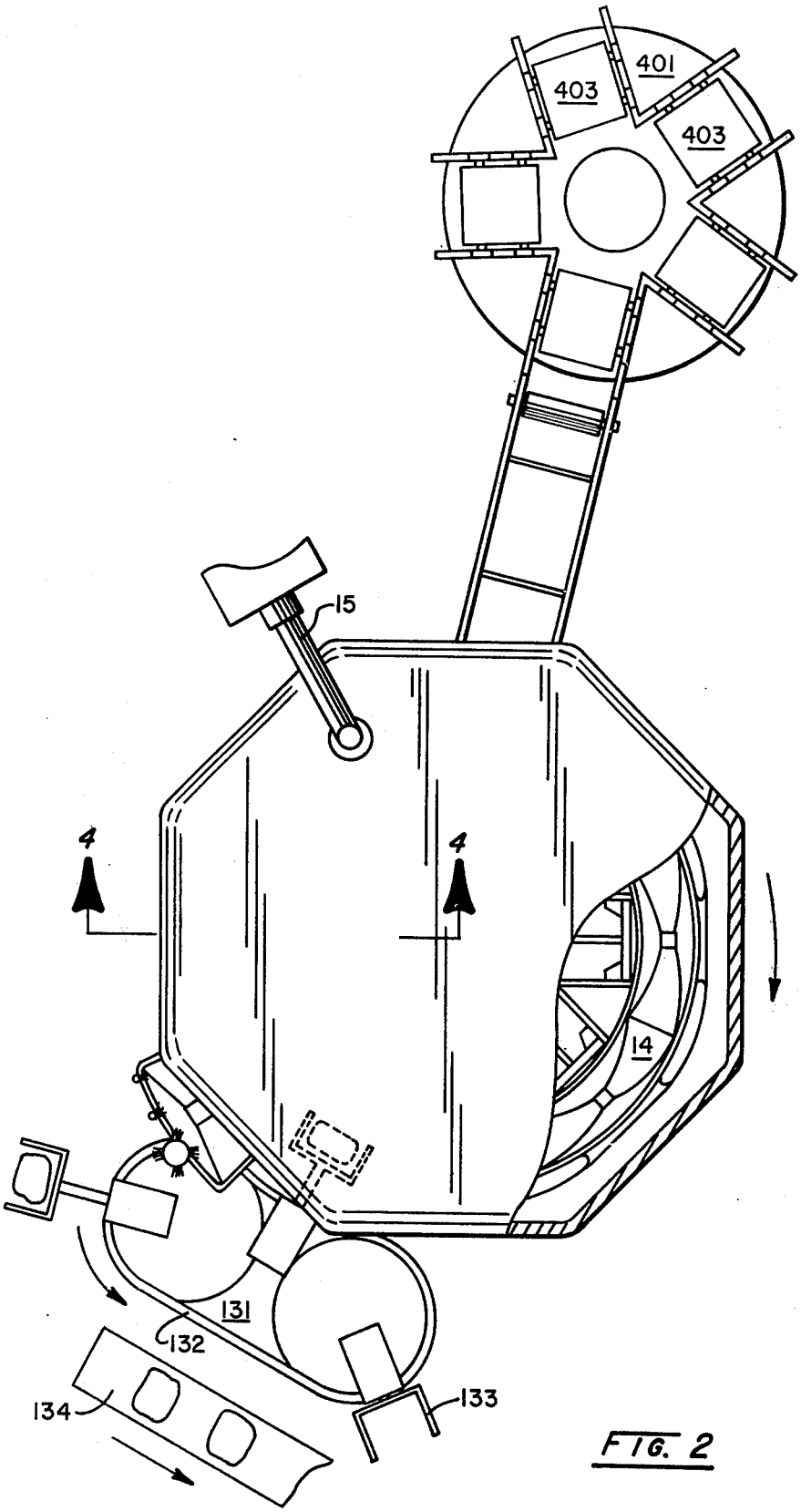
FIG. 2 is a plan view of the machine in FIG. 1 and auxiliary components, certain parts being shown as broken away in section.
Figure 3:
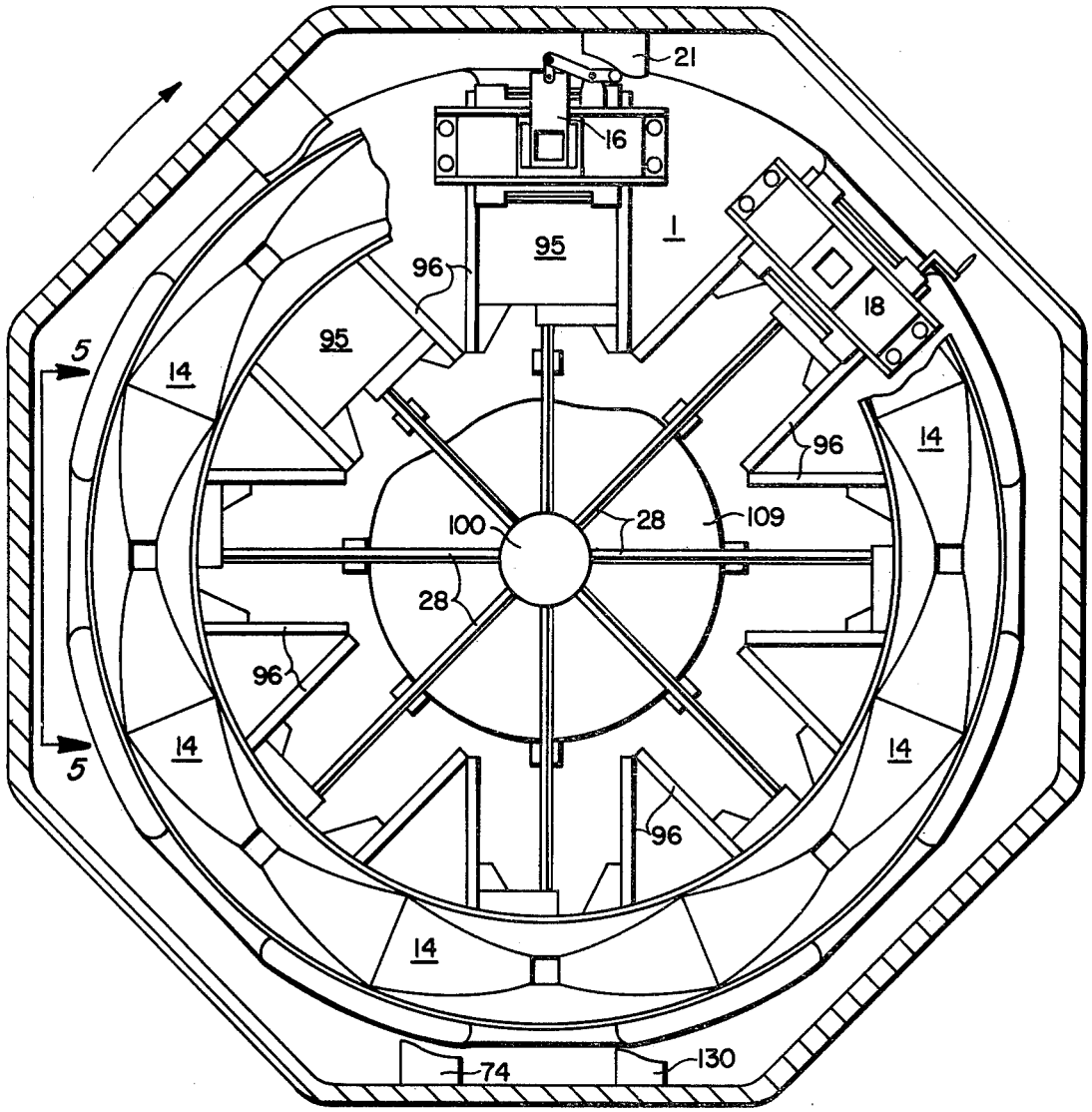
FIG. 3 is a plan view of the core making machine alone, with certain portions broken away.

324°-348° The lower half of the core box is maintained in an outwardly tilted position as the turntable continues to revolve and is now available for cleaning. Cleaning can be accomplished manually. However, a more preferred procedure is to contact the drag with a series of brushes and air blasts as indicated in FIGS. 1 and 2. The final treatment can be the application of a release agent.

348°-0° Conditioning of the lower half of the core box having been completed, at this point cam track 50 returns to a minimum cross sectional height and the drag rotates back to a horizontal position. One cycle has now been completed.

CORE RETRIEVAL AND ASSEMBLY EQUIPMENT

FIGS. 1 and 2 illustrate another facet of this invention, the equipment for removing and assembling cured molds and cores. In FIG. 2, reference numeral 131 denotes generally an endless belt system moving in a horizontal plane. The linear velocity of the belt is adjusted to the linear velocity of the cured cores as they are carried on the circumference of the machine. Adjacent to belt system 131 is a second conveyor belt 134 moving generally in a horizontal direction.

Attached to belt 132 are a plurality of finger assemblies 133 having a generally flat configuration. For most of a cycle around the belt 132, these finger assemblies move generally in a horizontal plane. The belt system 131, however, is constructed so that as the finger assemblies 133 approach the belt 134, they tilt toward it.

The removal system operates thus: As belt 132 travels, the finger assemblies 133 travel under the cured core or mold as it stands slightly elevated on ejector pins 85. Simultaneously, ejector pins 85 are depressed, thereby depositing the cured core or mold on the finger assembly. The cores then continue to be carried around the belt 132 until they reach the vicinity of the belt 134. At this point, the finger assembly supporting each core tilts and deposits the core/mold on belt 134. The cores are then carried by belt 134 to the point of use. This system can greatly facilitate the assembly of a number of cores and molds into an integrated whole. The core boxes necessary to mold the desired cores and/or molds can be arranged sequentially on the core making machine so that as they come from the machine and are deposited on belt 134 they will automatically be assembled into the desired groupings.

If the machine of this invention is to be used to produce only a sequence of cores or molds without a desire to assemble a number of cores and molds into an integrated assembly, then belt system 131 and belt 134 can be replaced by a simple moving belt designed to carry cores from the machine. The tilting mechanisms can be designed in combination with rejection pins to tilt a full 180° so that the cured cores are easily deposited on the belt.

Tilting of the drag outwardly is an important functon at the conclusion of the core making cycle. Tilting dislodges broken pieces of core and uncured sand into a container provided for the purpose. While the drag is maintained in a tilted position it is cleaned with an air stream directed from a compressed air nozzle and/or is brushed, as the face of the drag is carried around the circumference of the turret.

CORE BOX TRANSFER EQUIPMENT

Figure 18:
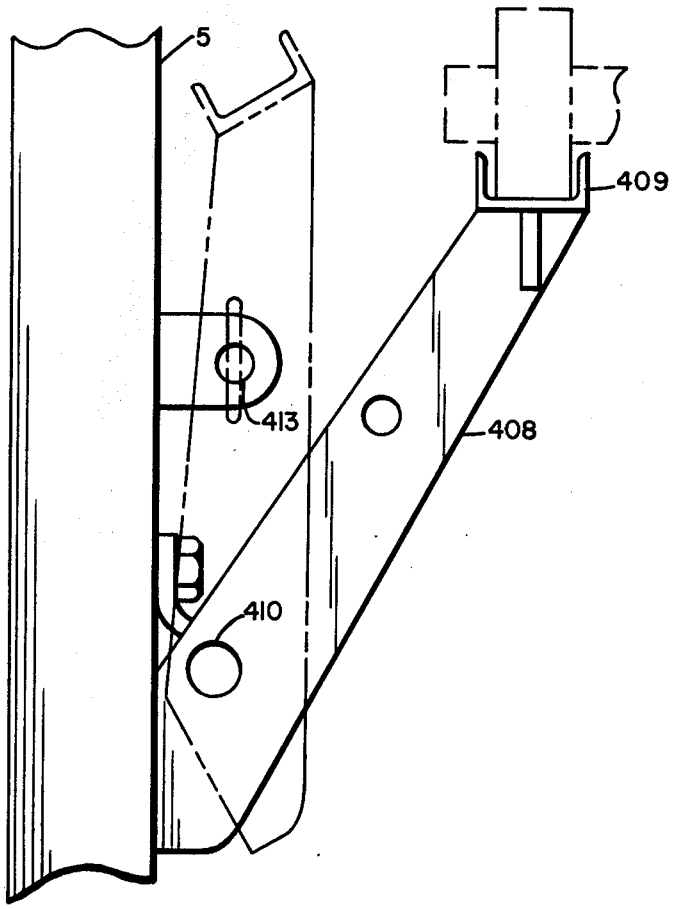
FIG. 18 is a vertical sectional view taken along line 18—18 in FIG. 17.

Another feature of the machine of this invention is that portion directed to the changing of core boxes. This feature makes rapid changes of core boxes possible. The core box transfer system is illustrated in detail in FIG. 1, 2, 17 and 18. Reference numeral 401 indicates generally a circular storage rack which supports one or more tiers 402 on which are stored a number of core box assemblies 403 which includes the upper half of the core box 26 (the cope), the lower half 27 (the drag) and the supporting member 67. The supporting member 67 carries rollers 404 which rest in support racks 406. These are rigidly attached to tier surface 402 by posts 405. Although only suggested in FIG. 17, tiers 402 can be raised or lowered hydraulically. Pivotally supported on posts 407 are a pair of transfer rails 409 which can be tilted either to a vertical position when not in use or lowered to a horizontal position when in use. Rail sections 409 are rigidly attached to pairs of posts 408 and **408*a*. Each pair of posts is pivotally attached at 410 and 411 to the opening walls 5 of each bay. Rail sections 409 can thus be lowered into position by pin 413, (FIG. 18**).

To utilize this transfer system, tier 402 is rotated until a vacant pair of rail sections 406 are positioned opposite rail sections 412. Sections 406 are aligned with rails 412 in lowered position. Rail sections 409 are lowered into position and into alignment with rail sections 412. The blowplate and core box frames are unclamped and the turret is rotated slightly until the supporting member 67 descends and the rollers 404 descend and rest upon rail sections 409. The core box assembly 26, 27 and 67 can then be pushed from rails 409, along rails 412 into position on rails 406. A replacement core box assembly in tier 402 is selected. Tier 402 is rotated until the selected assembly is aligned with rails 412. The core box assembly (26, 27 and 67) can then be pushed from rails 406 along rails 412 into place on rail section 409. By a slight rotation of the machine, table 35 can be made to rise and assume the weight of the core box assembly. At this time, the assembly can be clamped to a permanent position on lower section 66 and table 35. Rails 409 can then be pushed up against walls 5 and the turret rotated to the next bay to effect another change of core boxes.

CATALYST GAS GENERATING CIRCUIT

Figure 21:
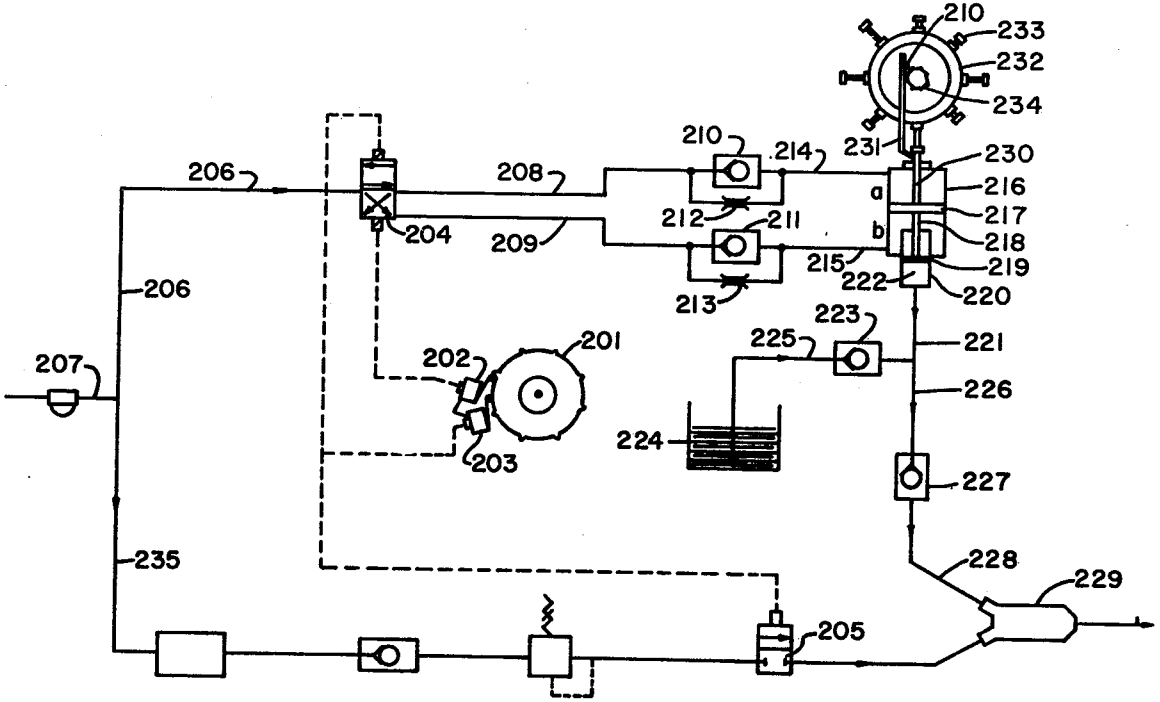
FIG. 21 is a diagram showing a new and novel method and apparatus for varying the volume of curing gas supplied to individual core boxes in the machine.

FIG. 21 depicts the generating circuit for the catalyst gas (particularly gaseous amines) used in the core making machine of this invention. Although a number of methods of generating catalyst curing gas can be used, the technique shown in this circuit is not, however, limited to this machine but can be readily adapted to use in other types or kinds of core making machines.

Reference numeral 201 indicates a timing wheel whose rotation is synchronized with the rotation of the turret and gas distribution valve 100. Limit switches 202 and 203 control the opening and closing of four-way directional valve 204 and two-way directional valve 205. Alternatively, in lieu of using limit switches, timing wheel 201 can be a ratchet mechanism directly activating valves 204 and 205. Conduit 206 connects air inlet conduit 207 and four-way directional valve 204. Conduits 208 and 209 connect with check valves 210 and 211 respectively, and by-pass valves 212 and 213. Conduits 214 and 215 connect the downstream ends of check valve 210 and 211, and the ends of bypass valves 212 and 213 to opposite ends of cylinder 216. Piston 217 is free to reciprocate within cylinder 215 when compressed air enters through either conduit 214 or 215. Piston rod 218 terminates in a second piston 219 positioned in a second cylinder 220. Conduit 221 connects chamber 222 defined by piston 219 and cylinder 220 to check valve 223 which in turn is connected to catalyst reservoir 224 by conduit 225. Catalyst reservoir 225 contains the liquid catalyst which is to be vaporized and flowed through the sand mold to solidify it. Conduit 226 branches from conduit 221 and connects with check valve 227. Conduit 228 connects check valve 227 and at vaporizer nozzle 229. Referring now to cylinder 216, piston rod 230 is connected to piston 217 and extends through stuffing boxes to maintain pressures within cylinder 216. Rod 230 is connected to the L-shaped pawl 231. Wheel 232 has ratchet wheel 234 attached to it and carries, on its circumference, a number of radially adjustable threaded stops 233. These stops, as will be apparent, control (in one direction) the stroke of piston 217, correspondingly the stroke of piston 219 in cylinder 220, and the size of the volume displaced therein. By screwing the stops 233 in or out, the volume of liquid catalyst removed from reservoir 224 and displaced to the vaporizer nozzle can be predetermined for each corresponding core box. Conduit 235 carries air through a heater, check valve, pressure reducing valve and two-way directional valve 205.

The sequence of operation of the gas generator circuit is controlled by the rotation of the timing wheel 201. When limit switch 202 is activated, solenoid valve 204 opens conduit 209 to the flow of compressed air and opens conduit 208 to exhaust to the atmosphere. The flow of air through conduit 209, valve 211 and conduit 215 into chamber 236 cause piston 217 to move in direction A in turn expanding the volume of chamber 222 in cylinder 220 and withdrawing liquid from catalyst reservoir 224. The volume of liquid withdrawn is, of course, indirectly determined by the adjustment of the stop 233. Simultaneously gas behind piston 217 is released through choke valve 212 and conduit 208. With the movement of piston 217 in direction A, pawl 231 is also forced back so that spring-activated catch 210 disengages ratchet wheel 234 as shown in FIG. 21. As the timing wheel 201 continues to turn in synchronization with the machine, limit switch 202 is activated causing valve 204 to open conduit 208 to the flow of compressed air and to exhaust conduit 209 to the atomsphere. Simultaneously, valve 205 is also opened, allowing compressed air to flow through conduit 235 into vaporizer nozzle 229. Compressed air flowing through conduit 214 forces piston 217 in direction B. Correspondingly piston rod 218 and piston 219 also move in the same direction forcing the liquid catalyst into conduit 226 through valve 227 and into vaporizer nozzle 229. From vaporizer nozzle 229, the mixture of air and vaporized catalyst flow to the rotary valve 100 in the machine.

CORE BOX CONSTRUCTION

FIG. 8 shows, in cross section, the design of the core box, (halves 26 and 27) and the supporting gas collection chamber 67 and 66. As noted previously, the lower half 66 of the gas collection chamber is generally made up of a wall 68, an interior shoulder 87, and a flat plate 79 supported by shoulders 87 and attached to scissors elevating linkage 75. The upper half 67 of the gas expansion chamber is made up of walls 131 corresponding to walls 68 of the lower gas expansion chamber 66 and has a second plate 84 which generally corresponds to plate 79 and supports pins 85 which extend vertically through the upper half 67 of the gas collection into the lower half of the core box 27. The bottom of the core box is recessed to accommodate the heads 132 of pins 85. Springs 86 are compressed between plate 84 and the bottom of the core box half 27. The upper half 26 of the core box generally corresponds to the lower half. In the top of the upper core box half 26 a plurality of pins 128 are located and retained in a vertical sliding relationship in holes 129A. Attached to the top of the upper core box half 26 is slide 133 which is held in place by a housing 134 or by other means. Slide 133 has in its bottom surface, slanted grooves 135 corresponding in number and pitch to the canted heads 136 of pins 128. Slide 133 is free to reciprocate a short distance horizontally. This movement has the effect of causing pins 128 to move up and down a short distance thereby displacing a core present in the core box. Rod 129 and spring 137 are maintained under compression as roller 138 at the end of rod 129 presses against cam track 130. It will be readily apparent that if the horizontal cross section of track 130 is changed, the rod 129 and slide 133 can be made to reciprocate horizontally, causing the pins 128 to move up and down. To avoid confusion in the drawings, only FIG. 8 shows this particular aspect of the core box and its associated cam track.

I claim:

1. Apparatus for installing core boxes in a rotary core making machine, said core boxes being provided with rollers on the sides thereof, comprising:

(a) at least one rotatable horizontally positioned circular plate adjustable as to height;

(b) a first plurality of pairs of rail sections rigidly attached in a horizontal position to said circular plate, corresponding in elevation to said rollers on said core boxes, arrayed around the circumference of said plate;

(c) a second pair of rails pivotally mounted at one end and positioned in proximity to the edge of said circular plate;

(d) corresponding pairs of third rail sections mounted at desired intervals on the circumference of said core making machine and adjustable to a level corresponding to the level of said second pair of rails when placed in a horizontal position.

* * * * *